US009533853B2

(12) United States Patent
Nakagawa et al.

(10) Patent No.: US 9,533,853 B2
(45) Date of Patent: Jan. 3, 2017

(54) SHEET PROCESSING APPARATUS AND IMAGE FORMING SYSTEM HAVING PLURAL ROLLER PAIRS

(71) Applicants: Yuuki Nakagawa, Kanagawa (CH); Kentaroh Fukami, Kanagawa (JP); Daishi Watanabe, Kanagawa (JP)

(72) Inventors: Yuuki Nakagawa, Kanagawa (CH); Kentaroh Fukami, Kanagawa (JP); Daishi Watanabe, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/680,434

(22) Filed: Apr. 7, 2015

(65) Prior Publication Data

US 2015/0321871 A1 Nov. 12, 2015

(30) Foreign Application Priority Data

May 12, 2014 (JP) ..... 2014-098870
Jan. 22, 2015 (JP) ..... 2015-010434

(51) Int. Cl.
*B65H 37/06* (2006.01)
*B65H 5/26* (2006.01)
(Continued)

(52) U.S. Cl.
CPC ..... *B65H 37/06* (2013.01); *B65H 5/068* (2013.01); *B65H 5/26* (2013.01); *B65H 7/20* (2013.01);
(Continued)

(58) Field of Classification Search
CPC ..... B65H 37/06; B65H 5/068; B65H 5/26; B65H 7/20; B65H 45/14; B65H 45/161
(Continued)

(56) References Cited

U.S. PATENT DOCUMENTS 5,993,369 A * 11/1999 Sekita ..... G03G 15/6582 493/25
6,092,803 A * 7/2000 Munenaka ..... B65H 9/103 271/242
(Continued)

FOREIGN PATENT DOCUMENTS

CN 102950911 A 3/2013
CN 103358718 A 10/2013
(Continued)

OTHER PUBLICATIONS

Extended European Search Report issued on Sep. 23, 2015 in Patent Application No. 15163885.5.
(Continued)

*Primary Examiner* — Patrick Mackey
(74) *Attorney, Agent, or Firm* — Oblon, McClelland, Maier & Neustadt, L.L.P.

(57) ABSTRACT

A sheet processing apparatus includes a conveyance roller pair that rotates in a certain direction to convey a sheet, a first normal-reverse rotation roller pair that is capable of rotating in a normal direction and a reverse direction and rotates to convey the sheet, a first driver that drives the first normal-reverse rotation roller pair to rotate, and a first driving force transmitter that transmits a driving force of the first driver for rotating the first normal-reverse rotation roller pair in a first specific direction to the conveyance roller pair so as to rotate the conveyance roller pair in the certain direction, and blocks a driving force of the first driver for rotating the first normal-reverse rotation roller pair in the direction opposite to the first specific direction from being transmitted to the conveyance roller pair.

10 Claims, 19 Drawing Sheets

(51) Int. Cl.

| | |
|---|---|
| ***B65H 5/06*** | (2006.01) |
| ***B65H 7/20*** | (2006.01) |
| ***B65H 45/16*** | (2006.01) |
| ***B65H 45/14*** | (2006.01) |

(52) U.S. Cl.
CPC ..... *B65H 45/14* (2013.01); *B65H 45/161* (2013.01); *B65H 2403/72* (2013.01); *B65H 2403/92* (2013.01); *B65H 2403/942* (2013.01); *B65H 2404/166* (2013.01); *B65H 2801/27* (2013.01)

(58) Field of Classification Search
USPC ..... 270/32, 45; 271/244, 246; 493/417, 442
See application file for complete search history.

(56) References Cited

U.S. PATENT DOCUMENTS

| | | | | |
|---|---|---|---|---|
| 6,171,225 | B1 * | 1/2001 | Nonoyama | B42C 1/12 270/58.12 |
| 6,730,010 | B2 * | 5/2004 | Yamakawa | B65H 45/12 493/267 |
| 7,658,372 | B2 | 2/2010 | Kubo | |
| 8,393,618 | B2 * | 3/2013 | Nakada | B65H 7/08 271/227 |
| 8,506,465 | B2 * | 8/2013 | Terhaag | B65H 45/20 493/416 |
| 9,016,679 | B2 * | 4/2015 | Kunieda | B31F 1/10 270/32 |
| 9,221,647 | B2 * | 12/2015 | Furuhashi | B65H 45/04 |
| 2001/0004142 | A1 | 6/2001 | Dorer | |
| 2002/0061215 | A1 | 5/2002 | Kamei | |
| 2005/0049131 | A1 | 3/2005 | Andolfi | |
| 2007/0052148 | A1 | 3/2007 | Kubo | |
| 2013/0256976 | A1 * | 10/2013 | Samoto | B65H 5/06 271/10.11 |
| 2014/0141956 | A1 | 5/2014 | Suzuki et al. | |
| 2014/0147184 | A1 | 5/2014 | Kunieda et al. | |
| 2014/0171283 | A1 | 6/2014 | Furuhashi et al. | |
| 2014/0179504 | A1 | 6/2014 | Nakada et al. | |
| 2014/0336031 | A1 | 11/2014 | Suzuki et al. | |
| 2014/0364295 | A1 | 12/2014 | Watanabe et al. | |
| 2015/0031520 | A1 | 1/2015 | Nakada et al. | |
| 2015/0166279 | A1 | 6/2015 | Samoto et al. | |
| 2016/0060072 | A1 * | 3/2016 | Watanabe | B65H 45/16 493/442 |

FOREIGN PATENT DOCUMENTS

| | | | |
|---|---|---|---|
| EP | 1 634 834 | A2 | 3/2006 |
| JP | 2002-284425 | A | 10/2002 |
| JP | 2003-261261 | A | 9/2003 |
| JP | 2006-027837 | A | 2/2006 |
| JP | 2006-117383 | | 5/2006 |
| JP | 2007-070094 | | 3/2007 |
| JP | 2007-070095 | | 3/2007 |

OTHER PUBLICATIONS

Office Action issued Aug. 8, 2016 in Chinese Patent Application No. 201510236018.6 (with English translation).

* cited by examiner

SHEET PROCESSING APPARATUS AND IMAGE FORMING SYSTEM HAVING PLURAL ROLLER PAIRS

CROSS-REFERENCE TO RELATED APPLICATIONS

The present application claims priority to and incorporates by reference the entire contents of Japanese Patent Application No. 2014-098870 filed in Japan on May 12, 2014 and Japanese Patent Application No. 2015-010434 filed in Japan on Jan. 22, 2015.

BACKGROUND OF THE INVENTION

1. Field of the Invention

The present invention relates to a sheet processing apparatus and an image forming system, and particularly, relates to folding processing on a sheet.

2. Description of the Related Art

Recently, computerization of information has been promoted. In the computerization, image processing apparatuses, such as printers and facsimiles used for outputting computerized information and scanners used for computerizing documents, have become indispensable instrument. Such image processing apparatuses are mostly structured as multifunction peripherals that can be used as printers, facsimiles, scanners, and copying machines with an image capturing function, an image forming function, and a communication function, for example, provided therein.

In such multifunction peripherals, a multifunction peripheral is known in which a sheet is fed and an image is drawn on the sheet by image forming, and thereafter folding processing is performed on the sheet on which the image has been formed by a folding processing apparatus included in the multifunction peripheral.

In such a folding processing apparatus, the following procedure is performed prior to the folding processing. A sheet is conveyed in a dedicated path along which the folding processing is performed. The sheet conveyed along the path is subjected to registration correction and then conveyed by a certain distance so as to adjust the position of the sheet. Thereafter, bending is formed at a folding position of the sheet. In the folding processing, the folding processing apparatus further conveys the sheet in which the bending is formed in such a manner that the position of the bending is not shifted so as to transfer the bending portion, and then sandwiches the transferred bending from both sides.

For performing such processing, the folding processing apparatus generally includes a plurality of driving mechanisms such as a mechanism for conveying a sheet in the path, a mechanism for the registration correction, a mechanism for forming the bending at a folding position, and a mechanism for sandwiching the transferred bending from both sides. A conventional technique is described in Japanese Patent Application Laid-open No. 2007-070095, for example.

The conventional folding processing apparatus performs the folding process on a sheet as described above by independently driving the driving mechanisms. The conventional folding processing apparatus, thus, needs to include a driving source such as a motor for driving a driving mechanism, for each of the above-described driving mechanisms.

The conventional folding processing apparatus needs to arrange driving sources for the respective driving mechanisms, thereby increasing the size of the apparatus due to the space required for the driving sources. In addition, a control system is required to control the driving sources, resulting in a complicated structure of the apparatus. As a result, a problem arises in that initial and running costs are increased.

In view of the above-described conventional problems, there is a need to provide a low cost folding processing apparatus that has a compact and simple structure and performs the folding processing on a sheet.

SUMMARY OF THE INVENTION

It is an object of the present invention to at least partially solve the problems in the conventional technology.

According to the present invention, there is provided a sheet processing apparatus, comprising: a conveyance roller pair that rotates in a certain direction to convey a sheet; a first normal-reverse rotation roller pair that is capable of rotating in a normal direction and a reverse direction and rotates to convey the sheet; a first driver that drives the first normal-reverse rotation roller pair to rotate; and a first driving force transmitter that transmits a driving force of the first driver for rotating the first normal-reverse rotation roller pair in a first specific direction to the conveyance roller pair so as to rotate the conveyance roller pair in the certain direction, and blocks a driving force of the first driver for rotating the first normal-reverse rotation roller pair in the direction opposite to the first specific direction from being transmitted to the conveyance roller pair.

The present invention also provides an image forming system, comprising: an image forming apparatus that performs image forming output on the sheet; and the above-described sheet processing apparatus.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENT

The following describes an embodiment of the invention in detail with reference to the accompanying drawings. In the embodiment, an image forming apparatus is exemplarily described in which a sheet such as a paper is fed and an image is drawn on the sheet by image forming, and thereafter folding processing is performed on the sheet on which the image has been formed by a folding processing unit included in the image forming apparatus.

Figure 1:
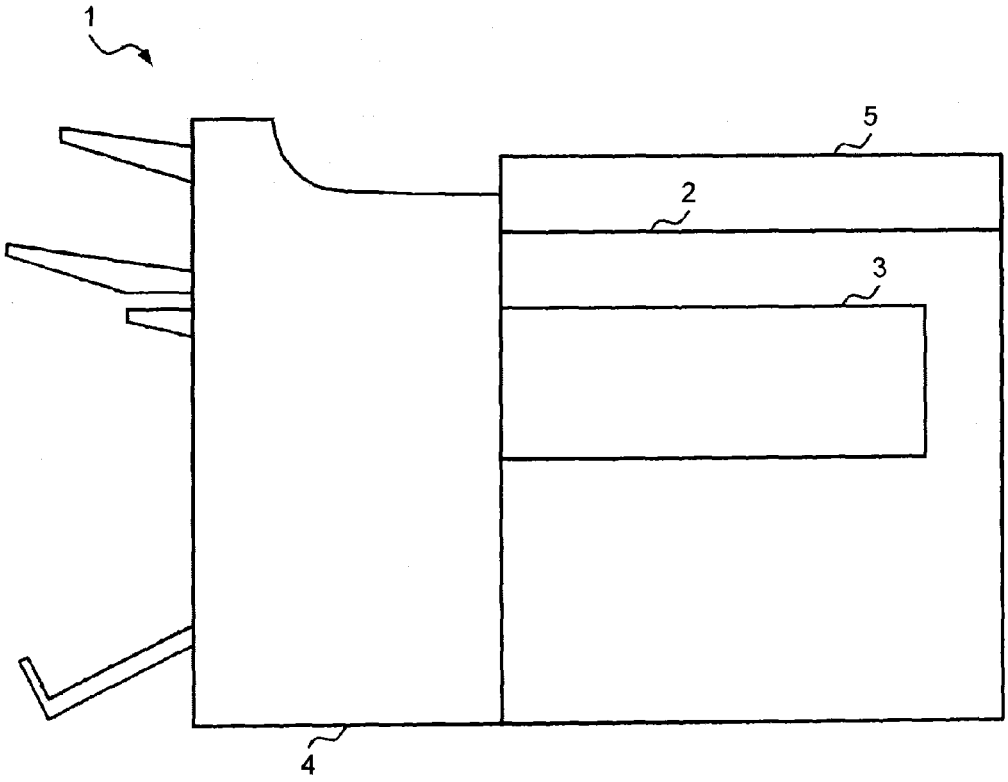
FIG. 1 is a schematic diagram illustrating a simplified overall structure of an image forming apparatus according to an embodiment of the invention.

The following describes an overall structure of an image forming apparatus 1 according to the embodiment with reference to FIG. 1. FIG. 1 is a schematic diagram illustrating a simplified overall structure of the image forming apparatus 1 according to the embodiment. As illustrated in FIG. 1, the image forming apparatus 1 according to the embodiment includes an image forming unit 2, a folding processing unit 3, an additional folding processing unit 4, and a scanner unit 5.

The image forming unit 2 produces drawing information about colors of cyan, magenta, yellow, and black (key plate) (CMYK) on the basis of input image data and performs image forming output on the fed sheet on the basis of the produced drawing information. The folding processing unit 3 performs the folding processing on the sheet, on which an image has been formed, conveyed from the image forming unit 2. In the embodiment, the folding processing unit 3 functions as a sheet processing apparatus. The structure included in the folding processing unit 3 is an aspect of the embodiment. The additional folding processing unit 4 performs additional folding processing on a fold formed on the sheet conveyed from the folding processing unit 3 after being subjected to the folding processing.

The scanner unit 5 computerizes an original by reading the original with a linear image sensor in which a plurality of photo diodes are arranged in a line and light receiving elements such as charge coupled devices (CCDs) or complementary metal oxide semiconductors (CMOSs) are arranged in parallel with the line. The image forming apparatus 1 according to the embodiment is a multifunction peripheral (MFP) that can be used as a printer, a facsimile, a scanner, and a copying machine by being provided with an image capturing function, an image forming function, and a communication function, for example.

Figure 2:
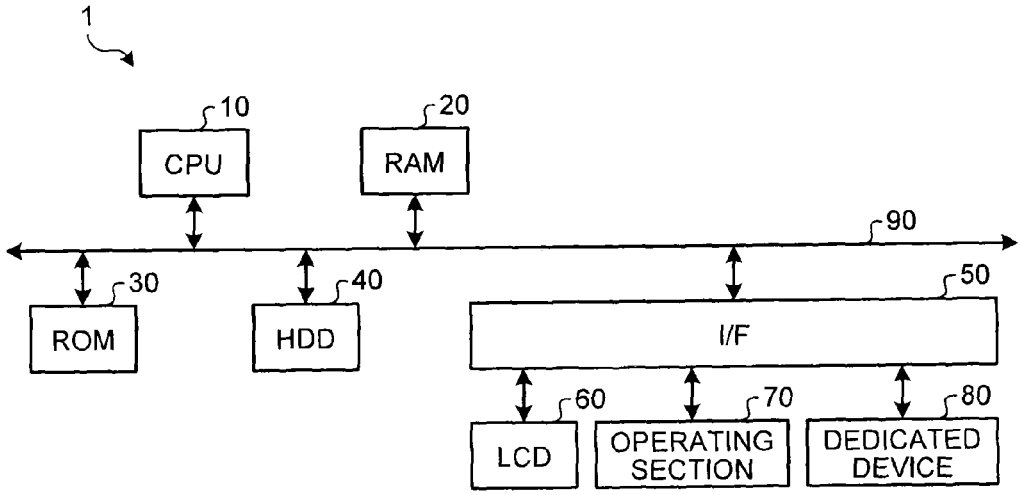
FIG. 2 is a block diagram schematically illustrating a hardware structure of the image forming apparatus according to the embodiment.

The following describes a hardware structure of the image forming apparatus 1 according to the embodiment with reference to FIG. 2. FIG. 2 is a block diagram schematically illustrating the hardware structure of the image forming apparatus 1 according to the embodiment. The image forming apparatus 1 further includes engines for performing scanning processing, printing processing, the folding processing, and the additional folding processing in addition to the hardware structure illustrated in FIG. 2.

As illustrated in FIG. 2, the image forming apparatus 1 according to the embodiment includes a structure similar to that of a typical server and personal computer (PC). The image forming apparatus 1 according to the embodiment includes a central processing unit (CPU) 10, a random access memory (RAM) 20, a read only memory (ROM) 30, a hard disk drive (HDD) 40, and an interface (I/F) 50 that are coupled with one another through a bus 90. A liquid crystal display (LCD) 60, an operating section 70, and a dedicated device 80 are coupled with the I/F 50.

The CPU 10 is an arithmetic unit, and controls operation of the whole of the image forming apparatus 1. The RAM 20 is a volatile storage medium that can read and write information at a high speed, and is used by the CPU 10 as a working area when processing information. The ROM 30 is a read-only non-volatile storage medium, and stores therein programs such as firmware. The HDD 40 is a non-volatile storage medium into or from which information can be written or read, and stores therein an operating system (OS), various control programs and application programs, for example.

The I/F 50 couples the bus 90 with various types of hardware and networks, for example, and controls them. The LCD 60 is a visual user interface with which a user checks the status of the image forming apparatus 1. The operating section 70 is a user interface, such as a keyboard or a mouse, with which a user inputs information to the image forming apparatus 1.

The dedicated device 80 is hardware for performing the respective dedicated functions in the image forming unit 2, the folding processing unit 3, the additional folding processing unit 4, and the scanner unit 5. In the image forming unit 2, the dedicated device 80 is a plotter that performs image forming output on a sheet. In the folding processing unit 3, the dedicated device 80 includes a conveyance mechanism that conveys a sheet and a folding processing mechanism that folds the conveyed sheet. The structure of the folding processing mechanism included in the folding processing unit 3 is an aspect of the embodiment In the additional folding processing unit 4, the dedicated device 80 is an additional folding processing mechanism that further performs the folding processing on the fold of the sheet conveyed after being subjected to the folding processing performed by the folding processing unit 3. In the scanner unit 5, the dedicated device 80 is a reading device that reads an image displayed on a sheet as an original.

In the hardware structure, programs stored in the ROM 30, the HDD 40, or a storage medium (not illustrated) such as an optical disc are loaded into the RAM 20. The CPU 10 performs arithmetic operation in accordance with the programs loaded in the RAM 20, thereby forming a software controller. By combining the software controller and the hardware, functional blocks for performing the functions of the image forming apparatus 1 according to the embodiment are structured.

Figure 3:
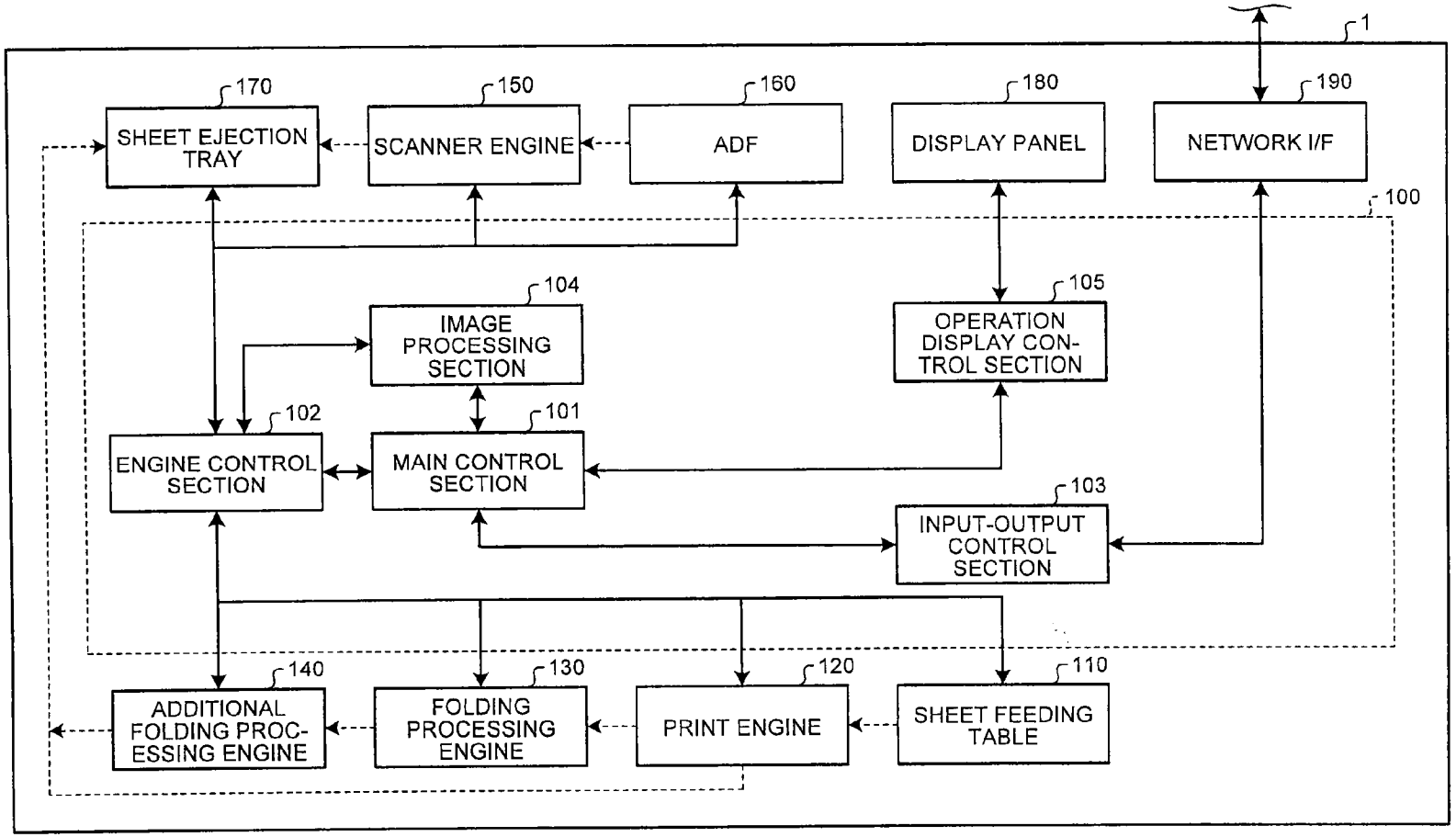
FIG. 3 is a block diagram schematically illustrating a functional structure of the image forming apparatus according to the embodiment.

The following describes a functional structure of the image forming apparatus 1 according to the embodiment with reference to FIG. 3. FIG. 3 is a block diagram schematically illustrating the functional structure of the image forming apparatus 1 according to the embodiment. In FIG. 3, solid arrows represent electrical connections while dotted arrows represent flows of a sheet or a bundle of sheets.

As illustrated in FIG. 3, the image forming apparatus 1 according to the embodiment includes a controller 100, a sheet feeding table 110, a print engine 120, a folding processing engine 130, an additional folding processing engine 140, a scanner engine 150, an auto document feeder (ADF) 160, a sheet ejection tray 170, a display panel 180, and a network I/F 190. The controller 100 includes a main control section 101, an engine control section 102, an input-output control section 103, an image processing section 104, and an operation display control section 105.

The sheet feeding table 110 feeds a sheet to the print engine 120 serving as an image forming section. The print engine 120 is included in the image forming unit 2 as the image forming section. The print engine 120 draws an image on the sheet conveyed from the sheet feeding table 110 by performing the image forming output on the sheet. Specifically, inkjet image forming mechanism or an electrophotographic image forming mechanism can be used as the print engine 120, for example. The sheet on which an image has been drawn by the print engine 120 (hereinafter also described as the image-formed sheet) is conveyed to the folding processing unit 3 or ejected to the sheet ejection tray 170.

The folding processing engine 130, which is included in the folding processing unit 3, performs the folding processing on the image-formed paper conveyed from the image forming unit 2. The sheet having been subjected to the folding processing performed by the folding processing engine 130 (hereinafter also described as the folded sheet) is conveyed to the additional folding processing unit 4. The additional folding processing engine 140, which is included in the additional folding processing unit 4, performs the additional folding processing on the fold formed on the folded sheet conveyed from the folding processing engine 130. The sheet having been subjected to the additional folding processing performed by the additional folding processing engine 140 (hereinafter also described as the additionally folded sheet) is ejected to the sheet ejection tray 170 or is conveyed to a post-processing unit (not illustrated) that performs post-processing such as stapling, punching, or binding.

The ADF 160, which is included in the scanner unit 5, automatically feeds an original to the scanner engine 150 serving as an original reading section. The scanner engine 150, which is included in the scanner unit 5 as the original reading section, includes photoelectric conversion elements that convert optical information into an electrical signal. The scanner engine 150 optically scans and reads an original automatically fed by the ADF 160 or an original set on an original table glass (not illustrated), and produces image information. The original read by the scanner engine 150 after being automatically fed by the ADF 160 is ejected to a sheet ejection tray included in the ADF 160.

The display panel 180 is an output interface that visually displays the status of the image forming apparatus 1, and is also an input interface used as a touch panel through which a user directly operates the image forming apparatus 1 or inputs information to the image forming apparatus 1. The display panel 180 includes a function to display an image for receiving the user's operation. The display panel 180 is implemented by the LCD 60 and the operating section 70 illustrated in FIG. 2. The network I/F 190 is an interface between the image forming apparatus 1 and other apparatuses such as administrator's terminals so as to communicate with each other through a network. The examples of the interface used as the network I/F 190 include an Ethernet (registered trademark) interface, a universal serial bus (USB) interface, a Bluetooth (registered trademark) interface, a wireless fidelity (Wi-Fi) interface, and a FeliCa (registered trademark) interface. The network I/F 190 is implemented by the I/F 50 illustrated in FIG. 2.

The controller 100 is structured by combining software and hardware. Specifically, the controller 100 is structured by the software controller and hardware such as an integrated circuit. The control programs such as firmware stored in a non-volatile storage medium such as the ROM 30 or the HDD 40 are loaded to the RAM 20. The CPU 10 performs arithmetic operation in accordance with the programs, thereby forming the software controller. The controller 100 functions as a control section that controls the whole of the image forming apparatus 1.

The main control section 101 plays a role of controlling the sections included in the controller 100, and sends commands to the sections of the controller 100. The main control section 101 controls the input-output control section 103 so as to access other apparatuses through the network I/F 190 and the network. The engine control section 102 controls or drives the driving sections such as the print engine 120, the folding processing engine 130, the additional folding processing engine 140, and the scanner engine 150. The input-output control section 103 inputs, to the main control section 101, signals and commands input through the network I/F 190 and the network.

The image processing section 104 produces drawing information on the basis of document data or image data included in an input print job under the control of the main control section 101. The drawing information is data such as bit-mapped data of CMYK and used by the print engine 120 serving as the image forming section to draw an image to be formed in the image forming operation. The image processing section 104 processes captured image data input from the scanner engine 150 and produces the image data. The image data is information that is stored in the image forming apparatus 1 or transmitted to other apparatuses through the network I/F 190 and the network as the result of the scanner's operation. The operation display control section 105 displays information on the display panel 180, or notifies the main control section 101 of information input through the display panel 180.

Figure 4:
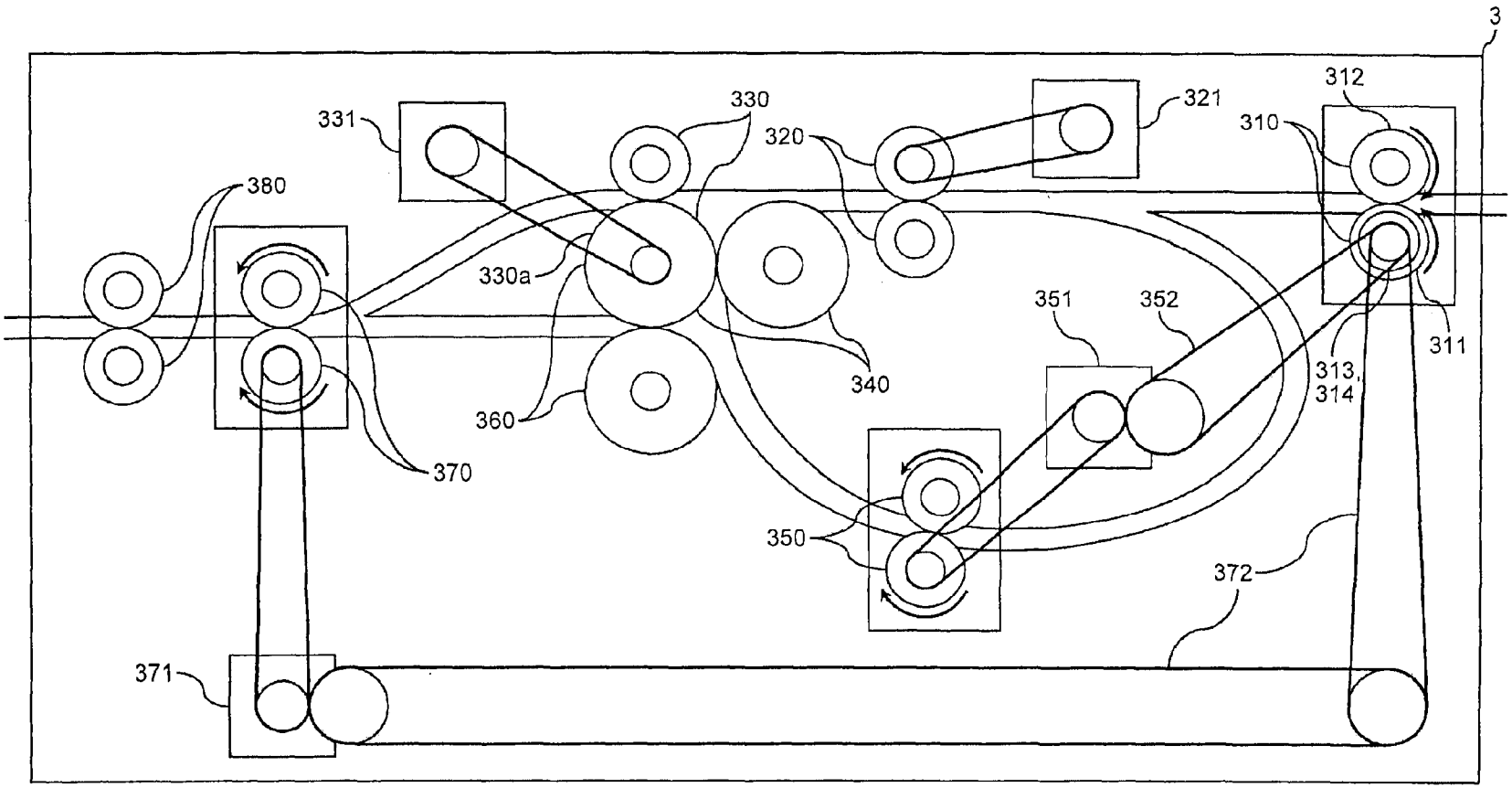
FIG. 4 is a cross-sectional view of a folding processing unit according to the embodiment viewed from a direction perpendicular to a sheet conveyance direction.
Figure 5:
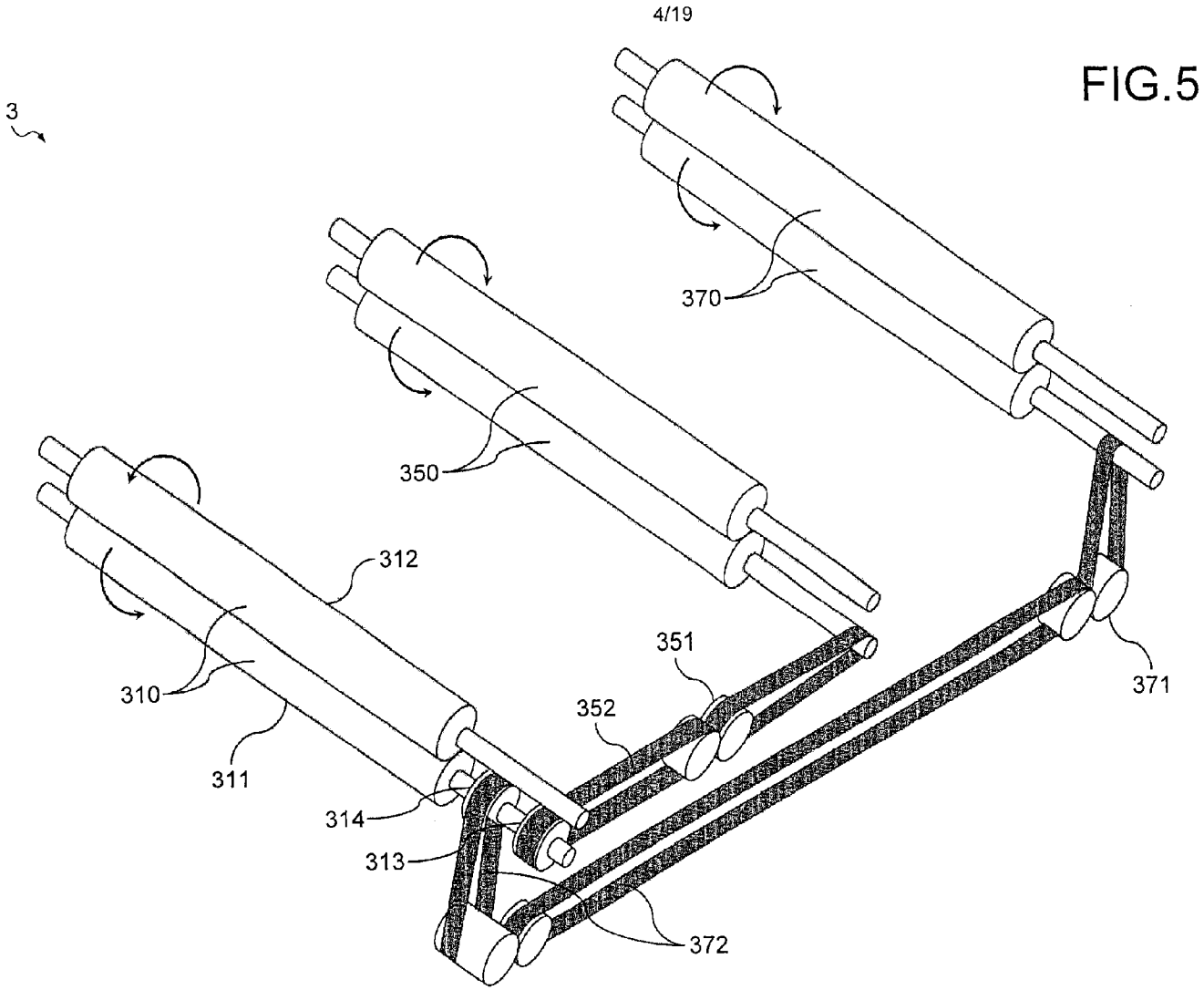
FIG. 5 is a perspective view of the folding processing unit according to the embodiment viewed obliquely from above.

The following describes an internal structure of the folding processing unit 3 according to the embodiment with reference to FIGS. 4 and 5. FIG. 4 is a cross-sectional view of the folding processing unit 3 according to the embodiment viewed from a direction perpendicular to a sheet conveyance direction. FIG. 5 is a perspective view of the folding processing unit 3 according to the embodiment viewed obliquely from above.

As illustrated in FIGS. 4 and 5, the folding processing unit 3 according to the embodiment includes an entrance conveyance roller pair 310, a registration roller pair 320, a relay conveyance roller pair 330, a first folding processing roller pair 340, a first normal-reverse rotation roller pair 350, a second folding processing roller pair 360, a second normal-reverse rotation roller pair 370, and a sheet ejection roller pair 380.

The registration roller pair 320 is driven to rotate by a driving motor 321. The registration roller pair 320 stops the rotation for a certain time while the front end of a sheet conveyed from the entrance conveyance roller pair 310 abuts a nip between the registration roller pair 320 so as to perform registration correction on the sheet. The registration roller pair 320 then conveys the sheet toward the relay conveyance roller pair 330 or the first folding processing roller pair 340.

The relay conveyance roller pair 330 is driven to rotate by a driving motor 331. The rotation of the relay conveyance roller pair 330 is reversed as needed. One roller of the first folding processing roller pair 340 also serves as a relay conveyance roller 330*a* of the relay conveyance roller pair 330. The first folding processing roller pair 340 is driven to rotate by the driving motor 331 through the relay conveyance roller 330*a*. The direction of the rotation of the first folding processing roller pair 340 is opposite to that of the relay conveyance roller pair 330.

The first normal-reverse rotation roller pair 350 is driven to rotate by a driving motor 351. The rotation of the first normal-reverse rotation roller pair 350 is reversed as needed. One roller of the second folding processing roller pair 360 also serves as the relay conveyance roller 330*a* of the relay conveyance roller pair 330. The second folding processing roller pair 360 is driven to rotate by the driving motor 331 through the relay conveyance roller 330*a*. The direction of the rotation of the second folding processing roller pair 360 is opposite to that of the relay conveyance roller pair 330.

The second normal-reverse rotation roller pair 370 is driven to rotate by a driving motor 371. The sheet ejection roller pair 380 is driven to rotate by a driving force transmitted from the driving motor 371 through a driving force transmission mechanism (not illustrated) structured with a gear train and driving belts, for example. The sheet ejection roller pair 380 rotates in the same direction as the second normal-reverse rotation roller pair 370.

The entrance conveyance roller pair 310 receives the image-formed sheet conveyed from the image forming unit 2 and conveys the sheet toward the registration roller pair 320. The entrance conveyance roller pair 310 according to the embodiment is composed of entrance conveyance rollers 311 and 312. The entrance conveyance roller 311 is provided with one-way clutches 313 and 314 on the rotation shaft thereof.

Each of the one-way clutches 313 and 314 is a mechanism that rotates the entrance conveyance roller 311 in a specific direction when being rotated in the specific direction and idles when being rotated in the direction opposite to the specific direction, thereby not rotating the entrance conveyance roller 311. In other words, the one-way clutches 313 and 314 are the mechanisms that rotate the entrance conveyance roller pair 310 only in a specific direction.

The one-way clutch 313 according to the embodiment is coupled with a driving force transmission mechanism 352 structured with a gear train and driving belts, for example. A driving force is transmitted to the one-way clutch 313 from the driving motor 351 through the driving force transmission mechanism 352. Because of the above-described function, the one-way clutch 313 according to the embodiment transmits only a driving force that rotates the entrance conveyance roller 311 in the specific direction to the entrance conveyance roller 311 out of the driving forces transmitted from the driving motor 351. On the other hand, because of the above-described function, the one-way clutch 313 according to the embodiment can block a driving force that rotates the entrance conveyance roller 311 in the direction opposite to the specific direction from being transmitted to the entrance conveyance roller 311 out of the driving forces transmitted from the driving motor 351.

In the embodiment, the entrance conveyance roller pair 310 is driven to rotate by the driving force transmitted from the driving motor 351 through the one-way clutch 313 and the driving force transmission mechanism 352. The entrance conveyance roller pair 310 rotates in the direction opposite to the direction of the rotation of the first normal-reverse rotation roller pair 350. The entrance conveyance roller pair 310 rotates only when the first normal-reverse rotation roller pair 350 rotates in the direction indicated with the arrows in FIGS. 4 and 5 due to the function of the one-way clutch 313. At that time, the entrance conveyance roller pair 310 rotates in such a direction that the entrance conveyance roller pair 310 conveys the sheet downstream in the conveyance direction, that is, in the forward direction of the conveyance direction as illustrated in FIGS. 4 and 5. In contrast, the entrance conveyance roller pair 310 according to the embodiment does not rotate when the first normal-reverse rotation roller pair 350 rotates in the direction opposite to the direction indicated with the arrows in FIGS. 4 and 5 because the driving force from the driving motor 351 is blocked from being transmitted to the entrance conveyance roller pair 310 due to the function of the one-way clutch 313. The entrance conveyance roller pair 310, thus, does not rotate in such a direction that the entrance conveyance roller pair 310 conveys the sheet upstream in the conveyance direction, that is, in the direction opposite to the conveyance direction.

The one-way clutch 314 according to the embodiment is coupled with a driving force transmission mechanism 372 structured with a gear train and driving belts, for example.

A driving force is transmitted to the one-way clutch 314 from the driving motor 371 through the driving force transmission mechanism 372. Because of the above-described function, the one-way clutch 314 according to the embodiment transmits only a driving force that rotates the entrance conveyance roller 311 in the specific direction to the entrance conveyance roller 311 out of the driving forces transmitted from the driving motor 371. On the other hand, because of the above-described function, the one-way clutch 314 according to the embodiment can block a driving force that rotates the entrance conveyance roller 311 in the direction opposite to the specific direction from being transmitted to the entrance conveyance roller 311 out of the driving forces transmitted from the driving motor 371.

In the embodiment, the entrance conveyance roller pair 310 is driven to rotate by the driving force transmitted from the driving motor 371 through the one-way clutch 314 and the driving force transmission mechanism 372. The entrance conveyance roller pair 310 rotates in the direction opposite to the direction of the rotation of the second normal-reverse rotation roller pair 370. The entrance conveyance roller pair 310 rotates only when the second normal-reverse rotation roller pair 370 rotates in the direction indicated with the arrows in FIGS. 4 and 5 due to the function of the one-way clutch 314. At that time, the entrance conveyance roller pair 310 rotates in such a direction that the entrance conveyance roller pair 310 conveys the sheet downstream in the conveyance direction as illustrated in FIGS. 4 and 5. In contrast, the entrance conveyance roller pair 310 according to the embodiment does not rotate when the second normal-reverse rotation roller pair 370 rotates in the direction opposite to the direction indicated with the arrows in FIGS. 4 and 5 because the driving force from the driving motor 371 is blocked from being transmitted to the entrance conveyance roller 311 due to the function of the one-way clutch 314. The entrance conveyance roller pair 310, thus, does not rotate in such a direction that the entrance conveyance roller pair 310 conveys the sheet upstream in the conveyance direction.

In the embodiment, the entrance conveyance roller pair functions as a conveyance roller pair, either the driving motor 351 or the driving motor 371 functions as either a first driver or a second driver, and either the one-way clutch 313 or the one-way clutch 314 functions as either a first driving force transmitter or a second driving force transmitter. In the embodiment, one driving motor the driving force of which is transmitted to the entrance conveyance roller pair 310 out of the driving motors 351 and 371 functions as a transmission driver and the other driving motor the driving force of which is not transmitted to the entrance conveyance roller pair 310 functions as a non-transmission driver.

The structure of the entrance conveyance roller pair 310 included in the folding processing unit 3 is an aspect of the embodiment. According to an aspect of the embodiment, in the folding processing unit 3 thus structured, the driving motors 351 and 371, which drive the first normal-reverse rotation roller pair 350 and the second normal-reverse rotation roller pair 370 to rotate, respectively, are used by being switched with each other in accordance with a change in the directions of the rotations thereof so as to drive the entrance conveyance roller pair 310 to rotate, thereby ensuring the entrance conveyance roller pair 310 to continue the rotation in an intended direction.

The folding processing unit 3 according to the embodiment can ensure the entrance conveyance roller pair 310 to continue the rotation in such a direction that the entrance conveyance roller pair 310 conveys the sheet downstream in the conveyance direction without requiring a dedicated driving motor that drives the entrance conveyance roller pair 310 to rotate. As a result, the folding processing unit 3 that has a compact and simple structure and performs the folding processing on the sheet can be provided with a low cost.

The following describes an exemplary operation when the folding processing unit 3 according to the embodiment performs the folding processing with reference to FIGS. 6A to 11B. FIGS. 6A to 11B are cross-sectional views of the folding processing unit 3 in the folding processing operation in the image forming apparatus 1 according to the embodiment viewed from the direction perpendicular to the sheet conveyance direction. The operations of the respective operation components described below are controlled by the main control section 101 and the engine control section 102. In the embodiment, the main control section 101 and the engine control section 102 function as a driving controller.

In FIGS. 6A to 11B, "ON" indicated on the arrow from the first normal-reverse rotation roller pair 350 to the entrance conveyance roller pair 310 represents that the driving force of the driving motor 351 that drives the first normal-reverse rotation roller pair 350 to rotate is capable of being transmitted to the entrance conveyance roller pair 310. The solid arrow represents that the driving force is actually transmitted while the dotted arrow represents that the driving force is capable of being transmitted but is not actually transmitted. In contrast, in FIGS. 6A to 11B, "OFF" indicated on the arrow from the first normal-reverse rotation roller pair 350 to the entrance conveyance roller pair 310 represents that the driving force of the driving motor 351 that drives the first normal-reverse rotation roller pair 350 to rotate is incapable of being transmitted to the entrance conveyance roller pair 310. The dotted arrow, in this case, represents that the driving force is not actually transmitted.

In FIGS. 6A to 11B, "ON" indicated on the arrow from the second normal-reverse rotation roller pair 370 to the entrance conveyance roller pair 310 represents that the driving force of the driving motor 371 that drives the second normal-reverse rotation roller pair 370 to rotate is capable of being transmitted to the entrance conveyance roller pair 310. The solid arrow represents that the driving force is actually transmitted while the dotted arrow represents that the driving force is capable of being transmitted but is not actually transmitted. In contrast, in FIGS. 6A to 11B, "OFF" indicated on the arrow from the second normal-reverse rotation roller pair 370 to the entrance conveyance roller pair 310 represents that the driving force of the driving motor 371 that drives the second normal-reverse rotation roller pair 370 to rotate is incapable of being transmitted to the entrance conveyance roller pair 310. The dotted arrow, in this case, represents that the driving force is not actually transmitted.

Figure 6A:
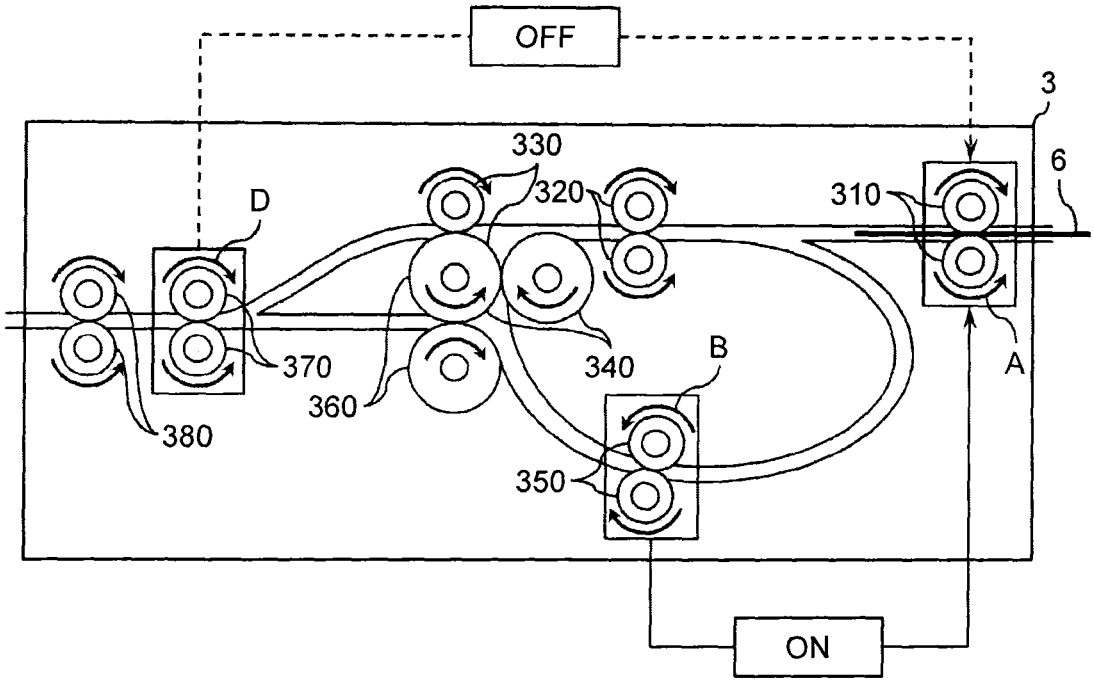
FIGS. 6A and 6B are cross-sectional views of the folding processing unit in a folding processing operation in the image forming apparatus according to the embodiment viewed from the direction perpendicular to the sheet conveyance direction.

The folding processing operation is performed by the folding processing unit 3 of the image forming apparatus 1 according to the embodiment as follows. As illustrated in FIG. 6A, the folding processing unit 3 receives the image-formed sheet 6 conveyed from the image forming unit 2 by the entrance conveyance roller pair 310, and conveys the sheet 6 toward the registration roller pair 320.

The folding processing unit 3 performs the registration correction on the image-formed sheet 6 conveyed by the entrance conveyance roller pair 310 using the registration roller pair 320. Thereafter, as illustrated in FIG. 6B, the folding processing unit 3 further conveys the sheet 6 downstream in the conveyance direction using the relay conveyance roller pair 330 and the second normal-reverse rotation roller pair 370.

Figure 6B:
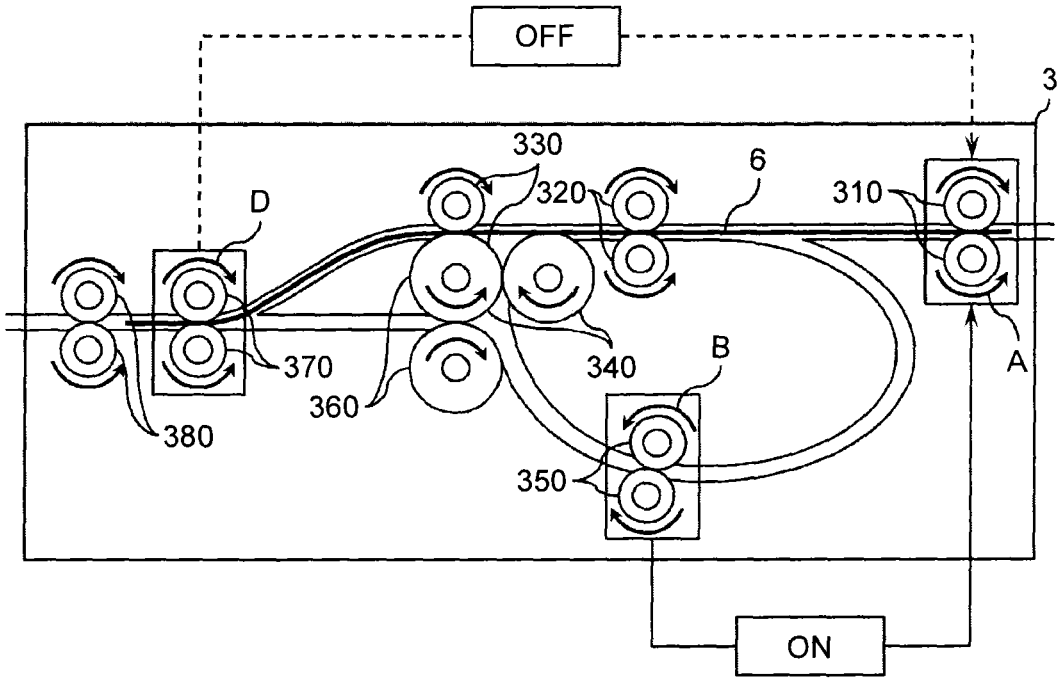

In FIGS. 6A and 6B, the entrance conveyance roller pair 310 is driven by the driving force transmitted from the driving motor 351 to rotate in the direction indicated with arrows A. The reason of the rotation is as follows. At this time, the driving motor 351 drives the first normal-reverse rotation roller pair 350 to rotate in the direction indicated with arrows B. As a result, the function of the one-way clutch 313 causes the driving force to be capable of being transmitted to the entrance conveyance roller pair 310. On the other hand, at this time, the driving motor 371 drives the second normal-reverse rotation roller pair 370 to rotate in the direction indicated with arrows D, resulting in the driving force being blocked by the function of the one-way clutch 314. As a result, the driving force is incapable of being transmitted to the entrance conveyance roller pair 310.

Figure 7A:
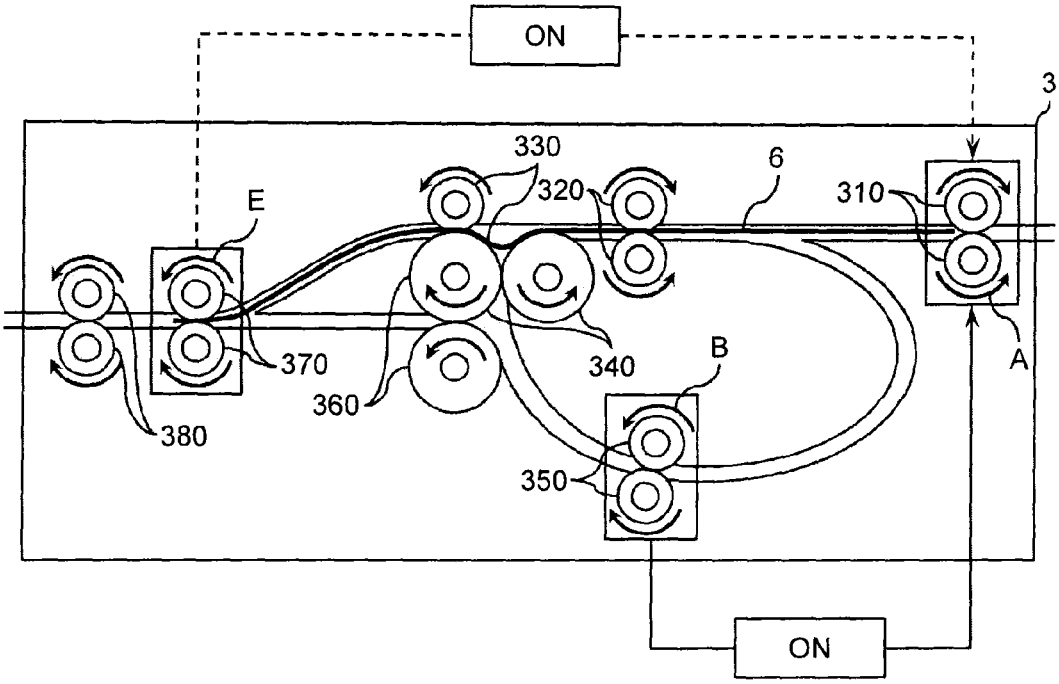
FIGS. 7A and 7B are cross-sectional views of the folding processing unit in the folding processing operation in the image forming apparatus according to the embodiment viewed from the direction perpendicular to the sheet conveyance direction.

The folding processing unit 3 conveys the sheet 6 by a certain distance. Then, as illustrated in FIG. 7A, the folding processing unit 3 reverses the rotations of the relay conveyance roller pair 330 and the second normal-reverse rotation roller pair 370, thereby causing a first folding position of the sheet 6 to be bent to a side adjacent to the first folding processing roller pair 340. The folding processing unit 3 further conveys the sheet 6 in such a manner that the position of the formed bending is not shifted while bending the first folding position, thereby guiding the bending to the nip between the first folding processing roller pair 340.

Figure 7B:
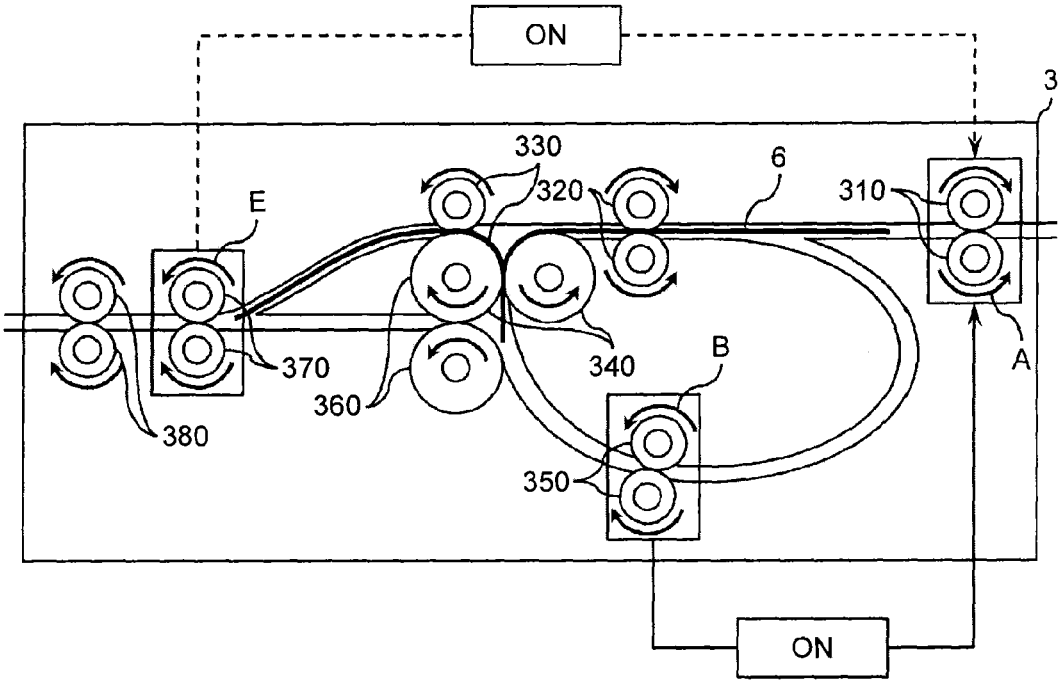

As illustrated FIG. 7B, the folding processing unit 3 forms a fold at the first folding position by sandwiching the bending formed on the sheet 6 from both sides at the nip between the first folding processing roller pair 340. Then, as illustrated in FIG. 8A, the folding processing unit 3 conveys the sheet 6 toward the first normal-reverse rotation roller pair 350 so as to further convey the sheet 6 downstream in the conveyance direction.

Figure 8A:
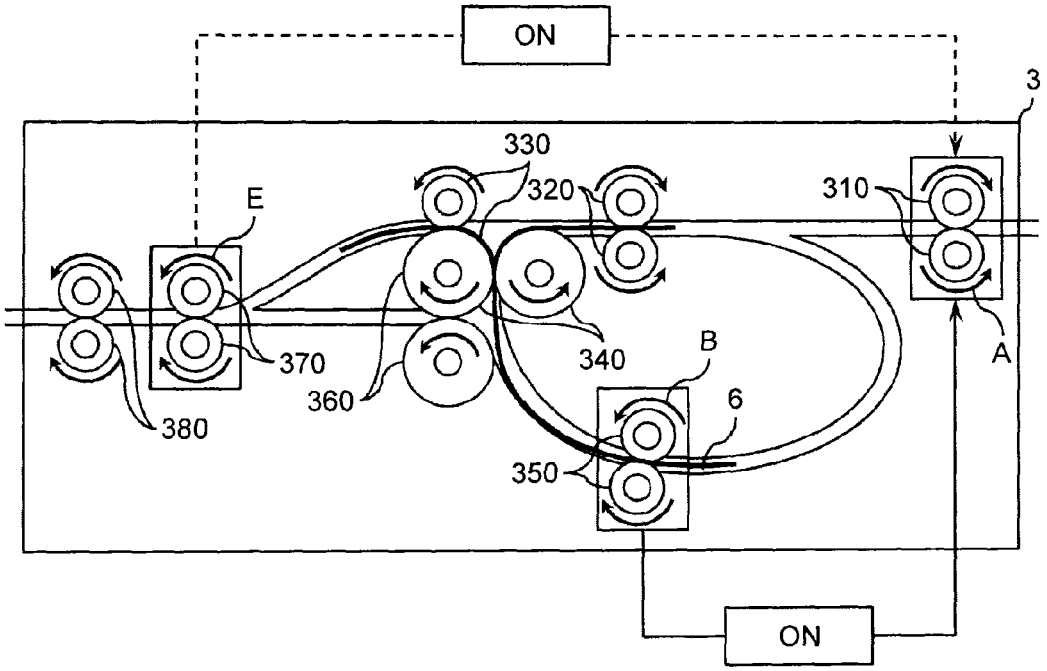
FIGS. 8A and 8B are cross-sectional views of the folding processing unit in the folding processing operation in the image forming apparatus according to the embodiment viewed from the direction perpendicular to the sheet conveyance direction.

In FIGS. 7A, 7B, and 8A, the second normal-reverse rotation roller pair 370 rotates in the direction indicated with arrows E while the first normal-reverse rotation roller pair 350 rotates in the direction indicated with arrows B. As a result, the driving force is capable of being transmitted to the entrance conveyance roller pair 310 from both of the driving motors 351 and 371. The entrance conveyance roller pair 310 is, however, actually driven to rotate in the direction indicated with arrows A by the driving force transmitted from only the driving motor 351.

The reason of the rotation is described below. The driving motor 351 drives the first normal-reverse rotation roller pair 350 to rotate in the direction indicated with arrows B. The driving motor 371 drives the second normal-reverse rotation roller pair 370 to rotate in the direction indicated with arrows E. The driving forces of both of the driving motors 351 and 371 are capable of being transmitted to the entrance conveyance roller pair 310 by the functions of the one-way clutches 313 and 314.

The driving speed of the driving motor 371 has, however, not been fully accelerated to the driving speed at which the driving motor 371 drives the entrance conveyance roller pair 310 to rotate without reducing the rotation speed of the entrance conveyance roller pair 310 driven by the driving motor 351 because it is shortly after when the driving motor 371 reverses the rotation of the second normal-reverse rotation roller pair 370. In other words, the entrance conveyance roller pair 310 is driven to rotate at a faster rotation speed than the rotation speed at which the driving motor 371 can currently drive the entrance conveyance roller pair 310 to rotate.

The driving force transmitted from the driving motor 371 to the one-way clutch 314 is, thus, blocked by the one-way clutch 314 being idle. As a result, the driving force is incapable of being transmitted to the entrance conveyance roller pair 310. In FIGS. 7A, 7B, and 8A, although the driving force is capable of being transmitted from both of the driving motors 351 and 371, the driving force is transmitted from only the driving motor 351 that can drive the entrance conveyance roller pair 310 to rotate faster than the driving motor 371 does. Because of the reason described above, in FIGS. 7A, 7B, and 8A, the entrance conveyance roller pair 310 is driven by the driving force transmitted from only the driving motor 351 to rotate in the direction indicated with arrows A.

The folding processing unit 3 according to the embodiment can transmit the driving force to the entrance conveyance roller pair 310 from only the driving motor 351 even when the driving force is capable of being transmitted to the entrance conveyance roller pair 310 from both of the driving motors 351 and 371 after the rotation of the second normal-reverse rotation roller pair 370 is reversed in FIGS. 7A, 7B, and 8A.

Figure 8B:
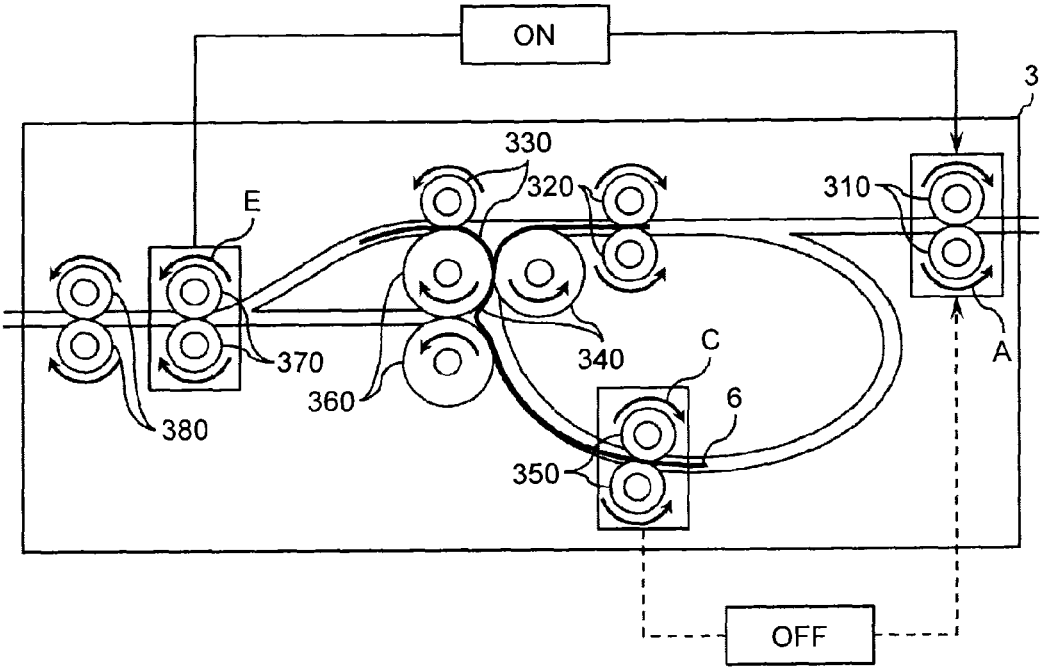

The folding processing unit 3 conveys the sheet 6 by a certain distance. Then, as illustrated in FIG. 8B, the folding processing unit 3 reverses the rotation of the first normal-reverse rotation roller pair 350, thereby causing a second folding position of the sheet 6 to be bent to a side adjacent to the second folding processing roller pair 360. The folding processing unit 3 further conveys the sheet 6 in such a manner that the position of the formed bending is not shifted while bending the second folding position, thereby guiding the bending to the nip between the second folding processing roller pair 360.

In FIG. 8B, the driving motor that transmits the driving force to the entrance conveyance roller pair 310 is switched from the driving motor 351 to the driving motor 371. The entrance conveyance roller pair 310 is, thus, driven to rotate in the direction indicated with arrows A by the driving force transmitted from the driving motor 371.

The reason of the rotation is described below. The driving motor 351 drives the first normal-reverse rotation roller pair 350 to rotate in the direction indicated with arrows C. The driving motor 371 drives the second normal-reverse rotation roller pair 370 to rotate in the direction indicated with arrows E. The driving force of the driving motor 351 is, thus, blocked by the function of the one-way clutch 313. As a result, the driving force is incapable of being transmitted to the entrance conveyance roller pair 310. The driving force of the driving motor 371 is capable of being transmitted to the entrance conveyance roller pair 310 by the function of the one-way clutch 314. Because of the reason described above, in FIG. 8B, the entrance conveyance roller pair 310 is driven by the driving force transmitted from the driving motor 371 to rotate in the direction indicated with arrows A.

Although, the driving force from the driving motor 351 is not transmitted to the entrance conveyance roller pair 310 after the rotation of the first normal-reverse rotation roller pair 350 is reversed in FIG. 8B, the folding processing unit 3 according to the embodiment can switch the driving motor that transmits the driving force to the entrance conveyance roller pair 310 from the driving motor 351 to the driving motor 371.

The driving speed of the driving motor 371 has been accelerated to the driving speed at which the driving motor 371 drives the entrance conveyance roller pair 310 to rotate without reducing the rotation speed of the entrance conveyance roller pair 310 driven by the driving motor 351 from the status illustrated in FIGS. 7A, 7B, and 8A, that is, the status when the rotation of the second normal-reverse rotation roller pair 370 is reversed. Although the driving force from the driving motor 351 is not transmitted to the entrance conveyance roller pair 310 after the rotation of the first normal-reverse rotation roller pair 350 is reversed in FIG. 8B, the folding processing unit 3 according to the embodiment can switch the driving motor that transmits the driving force to the entrance conveyance roller pair 310 from the driving motor 351 to the driving motor 371 without changing the rotation speed of the entrance conveyance roller pair 310.

As illustrated in FIG. 8B, the folding processing unit 3 guides the bending formed on the sheet 6 to the second folding processing roller pair 360. The folding processing unit 3, then, as illustrated in FIG. 9A, forms a fold at the second folding position by sandwiching the bending formed on the sheet 6 from both sides at the nip between the second folding processing roller pair 360, and conveys the sheet 6 toward the second normal-reverse rotation roller pair 370.

Figure 9A:
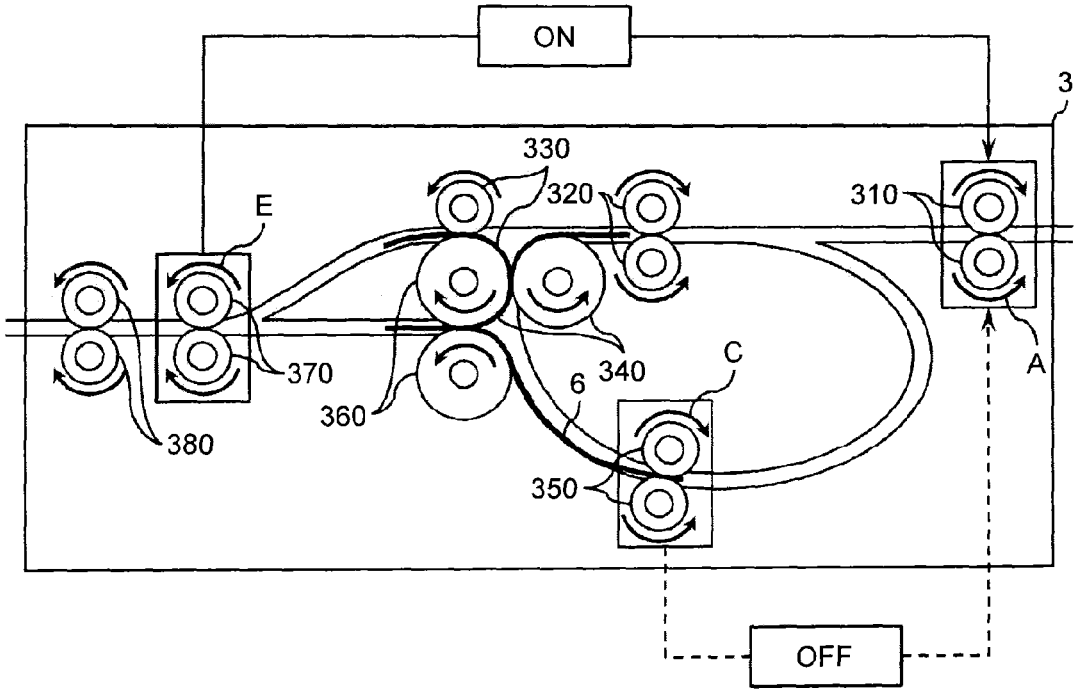
FIGS. 9A and 9B are cross-sectional views of the folding processing unit in the folding processing operation in the image forming apparatus according to the embodiment viewed from the direction perpendicular to the sheet conveyance direction.

In FIG. 9A, the entrance conveyance roller pair 310 is driven by the driving force transmitted from the driving motor 371 to rotate in the direction indicated with arrows A. The reason of the rotation is as follows. At this time, the driving motor 371 drives the second normal-reverse rotation roller pair 370 to rotate in the direction indicated with arrows E. As a result, the function of the one-way clutch 314 allows the driving force to be capable of being transmitted to the entrance conveyance roller pair 310. On the other hand, at this time, the driving motor 351 drives the first normal-reverse rotation roller pair 350 to rotate in the direction indicated with arrows C, resulting in the driving force being blocked by the function of the one-way clutch 313. As a result, the driving force is incapable of being transmitted to the entrance conveyance roller pair 310.

Figure 12:
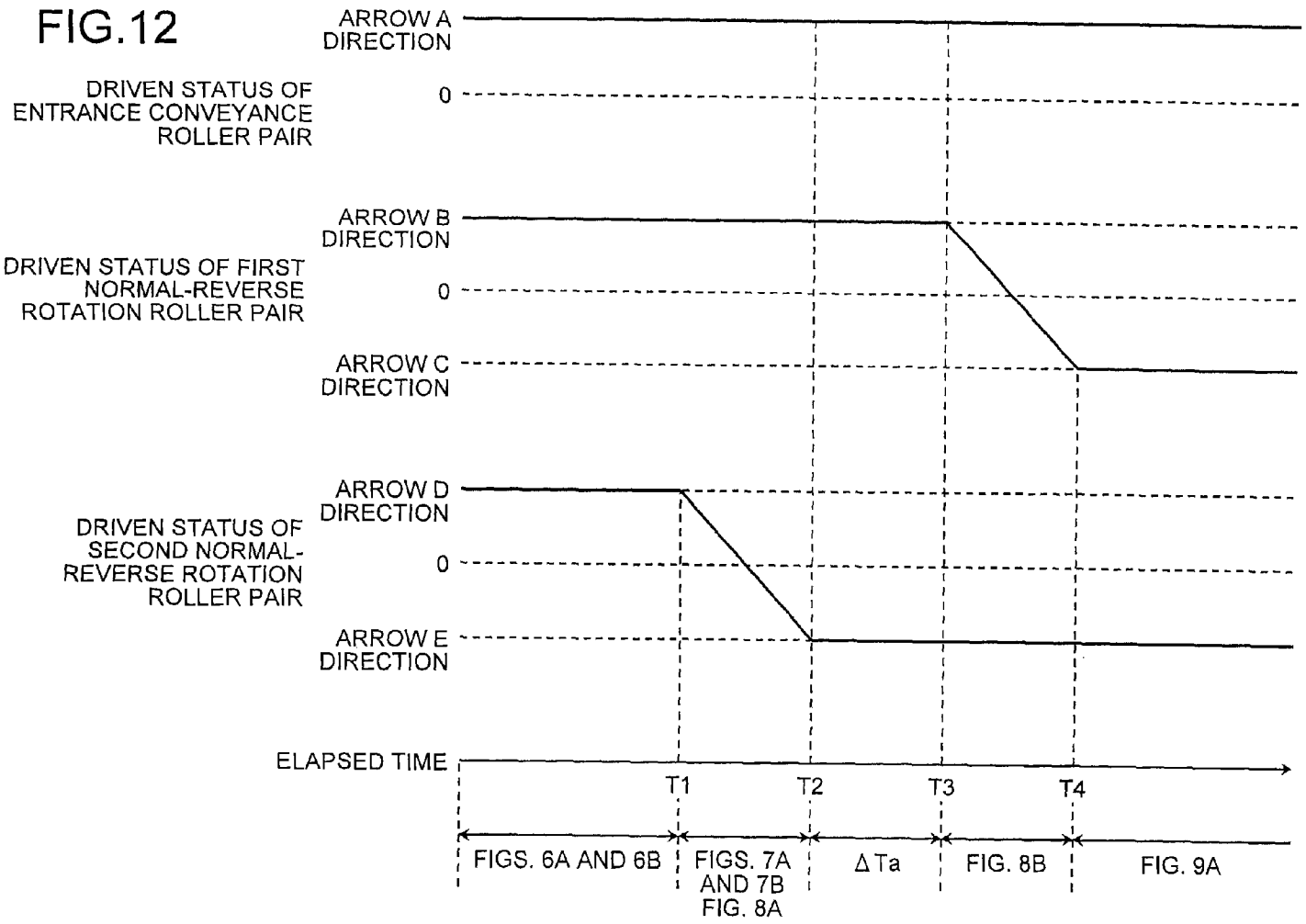
FIG. 12 is a schematic diagram illustrating a time-dependent change in driven statuses of respective roller pairs when the folding processing unit according to the embodiment switches a driving motor that transmits a driving force to an entrance conveyance roller pair.

The following describes a control procedure when the folding processing unit 3 according to the embodiment switches the driving motor that transmits the driving force to the entrance conveyance roller pair 310 from the driving motor 351 to the driving motor 371 with reference to FIG. 12. FIG. 12 is a schematic diagram illustrating a time-dependent change in driven statuses of the respective roller pairs when the folding processing unit 3 according to the embodiment switches the driving motor that transmits the driving force to the entrance conveyance roller pair 310 from the driving motor 351 to the driving motor 371.

As illustrated in FIG. 12, the folding processing unit 3 according to the embodiment drives the first normal-reverse rotation roller pair 350 to rotate in the direction indicated with arrows B and the second normal-reverse rotation roller pair 370 to rotate in the direction indicated with arrows D in FIGS. 6A and 6B until a time T1 elapses.

When the time T1 elapses, the folding processing unit 3 starts to reverse the rotation of the second normal-reverse rotation roller pair 370 in FIG. 7A and accelerates the rotation of the second normal-reverse rotation roller pair 370 in the opposite direction in FIGS. 7B and 8A. At this time, the driving speed of the driving motor 371 has not been fully accelerated because it is shortly after when the driving motor 371 reverses the rotation of the second normal-reverse rotation roller pair 370. From the time T1 to a time T2, only the driving force from the driving motor 351 is, thus, transmitted to the entrance conveyance roller pair 310.

When the time T2 elapses, the folding processing unit 3 completes the reversing of the rotation of the second normal-reverse rotation roller pair 370. At this time, the driving speed of the driving motor 371 has been accelerated to the driving speed at which the driving motor 371 can drive the entrance conveyance roller pair 310 to rotate without reducing the rotation speed of the entrance conveyance roller pair 310 driven by the driving motor 351.

When ΔTa (=T3−T2) elapses, the folding processing unit 3 starts to reverse the rotation of the first normal-reverse rotation roller pair 350 in FIG. 8B. At this time, the driving motor that transmits the driving force to the entrance conveyance roller pair 310 is switched from the driving motor 351 to the driving motor 371. ΔTa is equal to or larger than zero seconds.

The folding processing unit 3 accelerates the rotation of the first normal-reverse rotation roller pair 350 in the opposite direction in FIG. 8B. When a time T4 elapses, the reversing of the rotation of the first normal-reverse rotation roller pair 350 is completed. The folding processing unit 3 continues the driving of the entrance conveyance roller pair 310 to rotate by the driving force transmitted from the driving motor 371 in FIG. 9A after the time T4.

With such control, the folding processing unit 3 according to the embodiment switches the driving motor that transmits the driving force to the entrance conveyance roller pair 310 from the driving motor 351 to the driving motor 371.

Figure 9B:
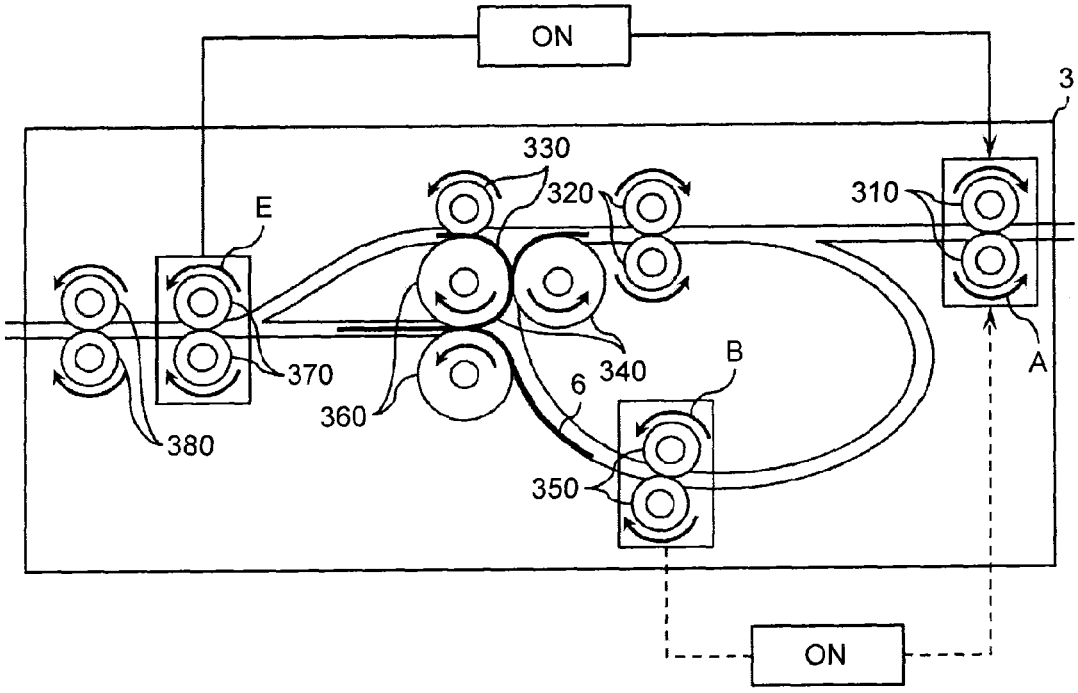

As illustrated in FIG. 9B, after the rear end of the sheet 6 passes through the first normal-reverse rotation roller pair 350, the folding processing unit 3 reverses the rotation of the first normal-reverse rotation roller pair 350.

In FIG. 9B, the second normal-reverse rotation roller pair 370 rotates in the direction indicated with arrows E while the first normal-reverse rotation roller pair 350 rotates in the direction indicated with arrows B. As a result, the driving force is capable of being transmitted to the entrance conveyance roller pair 310 from both of the driving motors 351 and 371. The entrance conveyance roller pair 310 is, however, actually driven to rotate in the direction indicated with arrows A by the driving force transmitted from only the driving motor 371.

The reason of the rotation is described below. The driving motor 351 drives the first normal-reverse rotation roller pair 350 to rotate in the direction indicated with arrows B illustrated in FIG. 9B. The driving motor 371 drives the second normal-reverse rotation roller pair 370 to rotate in the direction indicated with arrows E illustrated in FIG. 9B. The driving force is capable of being transmitted to the entrance conveyance roller pair 310 from both of the driving motors 351 and 371 by the functions of the one-way clutches 313 and 314.

The driving speed of the driving motor 351 has, however, not been fully accelerated to the driving speed at which the driving motor 351 drives the entrance conveyance roller pair 310 to rotate without reducing the rotation speed of the entrance conveyance roller pair 310 driven by the driving motor 371 because it is shortly after when the driving motor 351 reverses the rotation of the first normal-reverse rotation roller pair 350. In other words, the entrance conveyance roller pair 310 is driven to rotate at a faster rotation speed than the rotation speed at which the driving motor 351 can currently drive the entrance conveyance roller pair 310 to rotate.

The driving force transmitted from the driving motor 351 to the one-way clutch 313 is blocked by the one-way clutch 313 being idle. As a result, the driving force is incapable of being transmitted to the entrance conveyance roller pair 310. In FIG. 9B, although the driving force is capable of being transmitted from both of the driving motors 351 and 371, the driving force is transmitted from only the driving motor 371 that can drive the entrance conveyance roller pair 310 to rotate faster than the driving motor 351 does. Because of the reason described above, in FIG. 9B, the entrance conveyance roller pair 310 is driven by the driving force transmitted from only the driving motor 371 to rotate in the direction indicated with arrows A.

The folding processing unit 3 according to the embodiment can transmit the driving force to the entrance conveyance roller pair 310 from only the driving motor 371 even when the driving force is capable of being transmitted to the entrance conveyance roller pair 310 from both of the driving motors 351 and 371 after the rotation of the first normal-reverse rotation roller pair 350 is reversed in FIG. 9B.

Figure 10A:
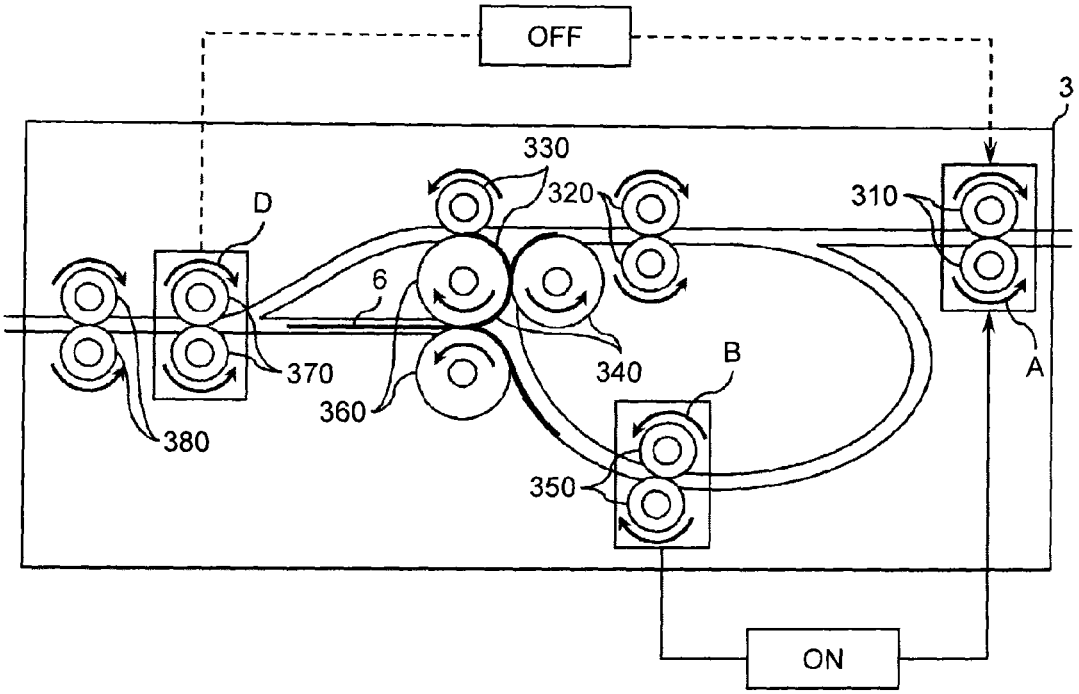
FIGS. 10A and 10B are cross-sectional views of the folding processing unit in the folding processing operation in the image forming apparatus according to the embodiment viewed from the direction perpendicular to the sheet conveyance direction.

Thereafter, as illustrated in FIG. 10A, the folding processing unit 3 reverses the rotation of the second normal-reverse rotation roller pair 370 so as to start to prepare for conveying the sheet 6 downstream in the conveyance direction.

In FIG. 10A, the driving motor that transmits the driving force to the entrance conveyance roller pair 310 is switched from the driving motor 371 to the driving motor 351. The entrance conveyance roller pair 310 is, thus, driven to rotate in the direction indicated with arrows A by the driving force transmitted from the driving motor 351.

The reason of the rotation is described below. The driving motor 351 drives the first normal-reverse rotation roller pair 350 to rotate in the direction indicated with arrows B illustrated in FIG. 10A. The driving motor 371 drives the second normal-reverse rotation roller pair 370 to rotate in the direction indicated with arrows D illustrated in FIG. 10A. The driving force of the driving motor 371 is, thus, blocked by the function of the one-way clutch 314. As a result, the driving force is incapable of being transmitted to the entrance conveyance roller pair 310. The driving force of the driving motor 351 is capable of being transmitted to the entrance conveyance roller pair 310 by the function of the one-way clutch 313. Because of the reason described above, in FIG. 10A, the entrance conveyance roller pair 310 is driven by the driving force transmitted from the driving motor 351 to rotate in the direction indicated with arrows A.

Although the driving force from the driving motor 371 is not transmitted to the entrance conveyance roller pair 310 after the rotation of the second normal-reverse rotation roller pair 370 is reversed in FIG. 10A, the folding processing unit 3 according to the embodiment can switch the driving motor that transmits the driving force to the entrance conveyance roller pair 310 from the driving motor 371 to the driving motor 351.

The driving speed of the driving motor 351 has been accelerated to the driving speed at which the driving motor 351 can drive the entrance conveyance roller pair 310 to rotate without reducing the rotation speed of the entrance conveyance roller pair 310 driven by the driving motor 371 from the status illustrated in FIG. 9B, that is, the status when the rotation of the first normal-reverse rotation roller pair 350 is reversed. Although the driving force from the driving motor 371 is not transmitted to the entrance conveyance roller pair 310 after the rotation of the second normal-reverse rotation roller pair 370 is reversed in FIG. 10A, the folding processing unit 3 according to the embodiment can switch the driving motor that transmits the driving force to the entrance conveyance roller pair 310 from the driving motor 371 to the driving motor 351 without changing the rotation speed of the entrance conveyance roller pair 310.

Figure 10B:
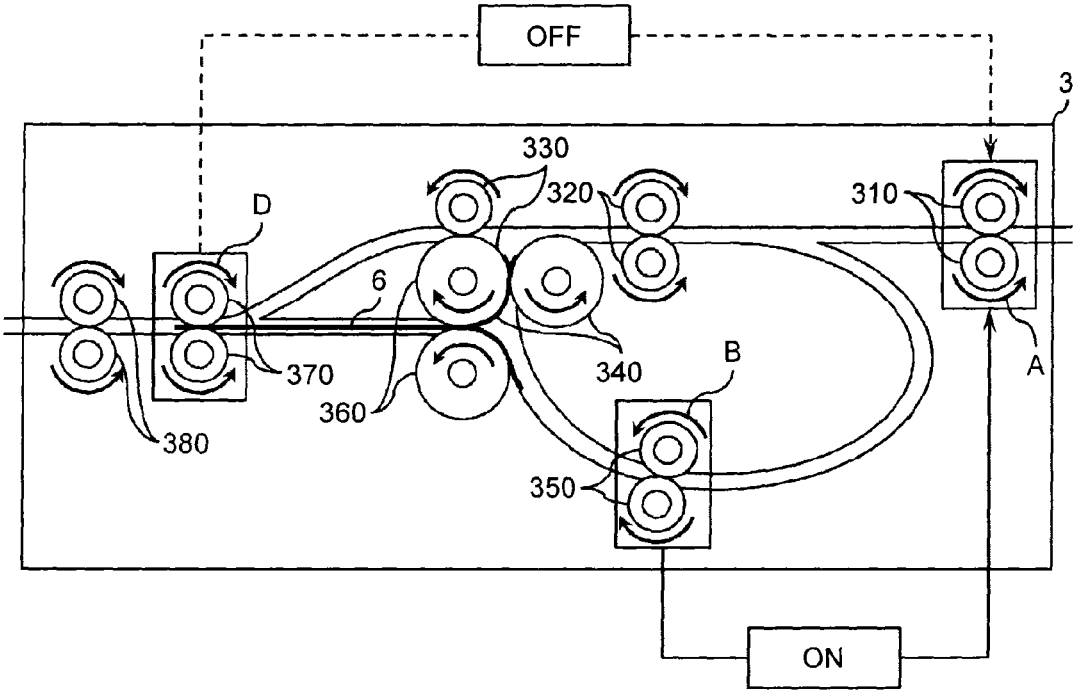

As illustrated in FIG. 10B, the folding processing unit 3 conveys the sheet 6 conveyed from the second folding processing roller pair toward the sheet ejection roller pair 380 by the second normal-reverse rotation roller pair 370.

In FIG. 10B, the entrance conveyance roller pair 310 is driven by the driving force transmitted from the driving motor 351 to rotate in the direction indicated with arrows A. The reason of the rotation is as follows. At this time, the driving motor 351 drives the first normal-reverse rotation roller pair 350 to rotate in the direction indicated with arrows B illustrated in FIG. 10B. As a result, the function of the one-way clutch 313 allows the driving force to be capable of being transmitted to the entrance conveyance roller pair 310. On the other hand, at this time, the driving motor 371 drives the second normal-reverse rotation roller pair 370 to rotate in the direction indicated with arrows D illustrated in FIG. 10B, resulting in the driving force being blocked by the function of the one-way clutch 314. As a result, the driving force is incapable of being transmitted to the entrance conveyance roller pair 310.

Figure 11A:
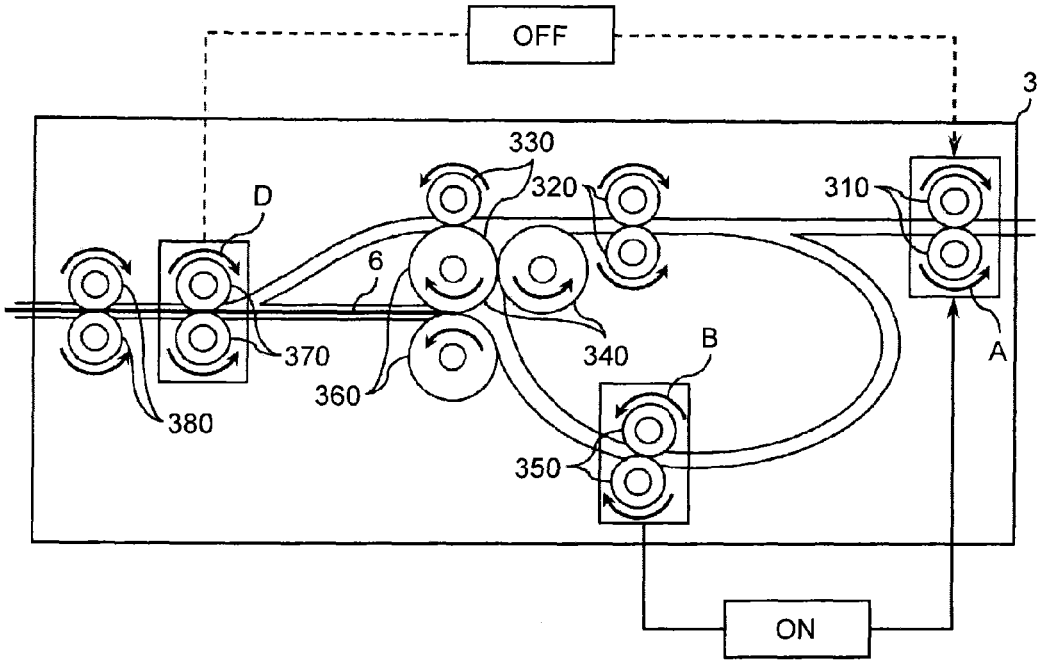
FIGS. 11A and 11B are cross-sectional views of the folding processing unit in the folding processing operation in the image forming apparatus according to the embodiment viewed from the direction perpendicular to the sheet conveyance direction.
Figure 11B:
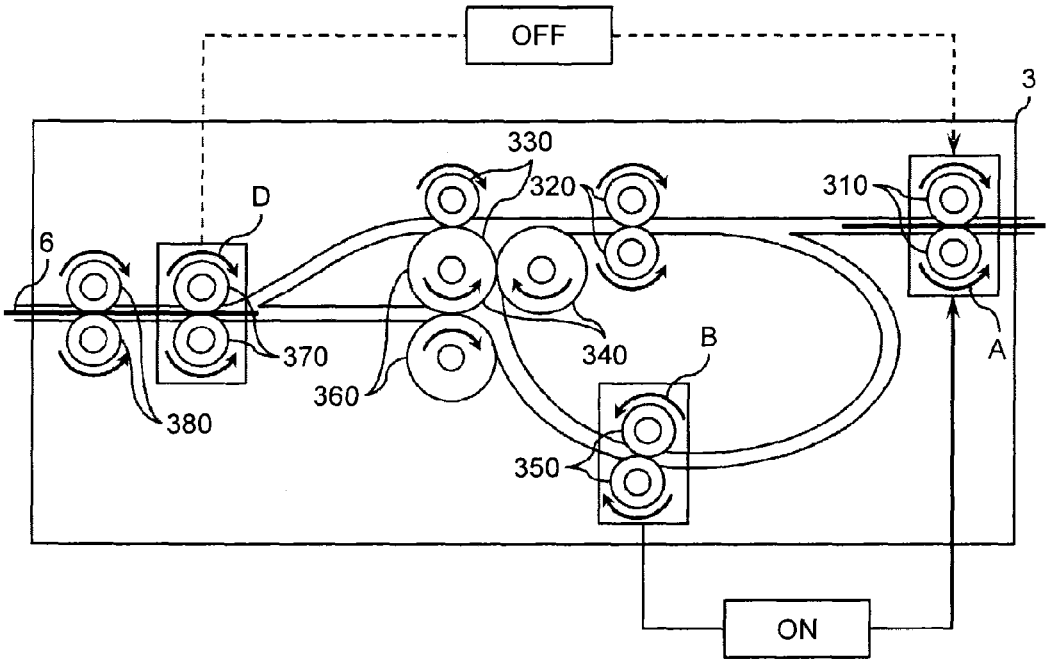

When the sheet 6 is conveyed to the sheet ejection roller pair 380, the folding processing unit 3 ejects the sheet 6 by the sheet ejection roller pair 380 as illustrated in FIG. 11A, and receives the image-formed sheet 6 newly conveyed from the image forming unit 2 by the entrance conveyance roller pair 310 as illustrated in FIG. 11B. The folding processing unit 3, then, performs the same processing as that described with reference to FIGS. 6A to 11A.

At this time, the driving force from the driving motor 371 is blocked from being transmitted to the entrance conveyance roller pair 310 in the folding processing unit 3. The folding processing unit 3, thus, can drive the second normal-reverse rotation roller pair 370 and the entrance conveyance roller pair 310 to rotate independently in accordance with the conveyance speeds of the sheet 6 of the respective second normal-reverse rotation roller pair 370 and the entrance conveyance roller pair 310 even when the conveyance speeds differ from each other.

Figure 13:
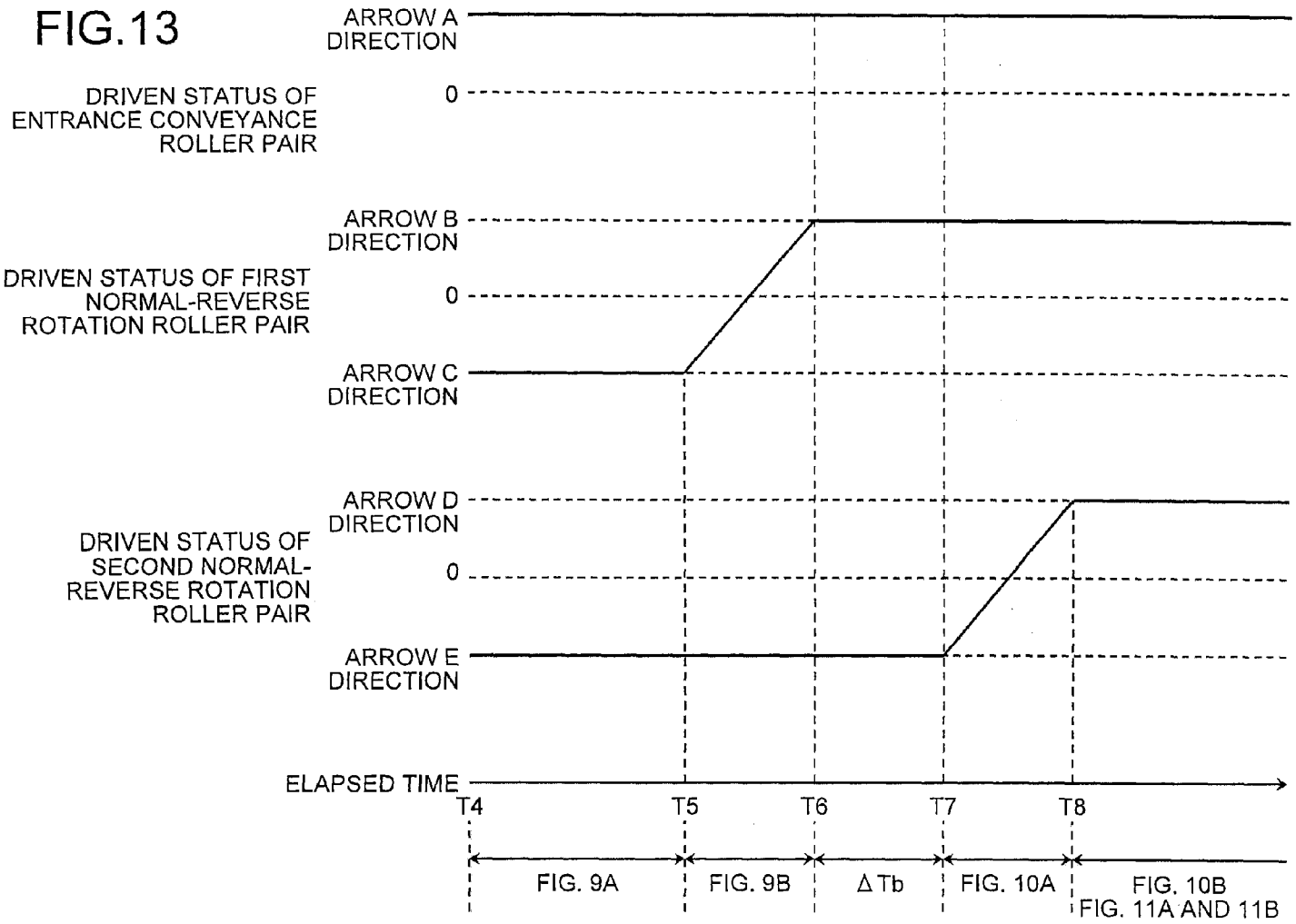
FIG. 13 is a schematic diagram illustrating a time-dependent change in driven statuses of the respective roller pairs when the folding processing unit according to the embodiment switches the driving motor that transmits the driving force to the entrance conveyance roller pair.

The following describes a control procedure when the folding processing unit 3 according to the embodiment switches the driving motor that transmits the driving force to the entrance conveyance roller pair 310 from the driving motor 371 to the driving motor 351 with reference to FIG. 13. FIG. 13 is a schematic diagram illustrating a time-dependent change in driven statuses of the respective roller pairs when the folding processing unit 3 according to the embodiment switches the driving motor that transmits the driving force to the entrance conveyance roller pair 310 from the driving motor 371 to the driving motor 351.

As illustrated in FIG. 13, the folding processing unit 3 according to the embodiment drives the first normal-reverse rotation roller pair 350 to rotate in the direction indicated with arrows C and the second normal-reverse rotation roller pair 370 to rotate in the direction indicated with arrows E in FIG. 9A until a time T5 elapses.

When the time T5 elapses, the folding processing unit 3 starts to reverse the rotation of the first normal-reverse rotation roller pair 350 in FIG. 9B and accelerates the rotation of the first normal-reverse rotation roller pair 350 in the opposite direction. At this time, the driving speed of the driving motor 351 has not been fully accelerated because it is shortly after when the driving motor 351 reverses the rotation of the first normal-reverse rotation roller pair 350. From the time T5 to a time T6, only the driving force from the driving motor 371 is, thus, transmitted to the entrance conveyance roller pair 310.

When the time T6 elapses, the folding processing unit 3 completes the reversing of the rotation of the first normal-reverse rotation roller pair 350. At this time, the driving speed of the driving motor 351 has been accelerated to the driving speed at which the driving motor 351 can drive the entrance conveyance roller pair 310 to rotate without reducing the rotation speed of the entrance conveyance roller pair 310 driven by the driving motor 371.

When ΔTb (=T7−T6) elapses, the folding processing unit 3 starts to reverse the rotation of the second normal-reverse rotation roller pair 370 in FIG. 10A. At this time, the driving motor that transmits the driving force to the entrance conveyance roller pair 310 is switched from the driving motor 371 to the driving motor 351. ΔTb is equal to or larger than zero seconds.

The folding processing unit 3 accelerates the rotation of the second normal-reverse rotation roller pair 370 in the opposite direction. When a time T8 elapses, the reversing of the rotation of the second normal-reverse rotation roller pair 370 is completed. The folding processing unit 3 continues the driving of the entrance conveyance roller pair 310 to rotate by the driving force transmitted from the driving motor 351 in FIGS. 10B, 11A, and 11B after the time T8.

With such control, the folding processing unit 3 according to the embodiment switches the driving motor that transmits the driving force to the entrance conveyance roller pair 310 from the driving motor 371 to the driving motor 351.

The folding processing unit 3 according to the embodiment is configured to form a fold at a certain position on the sheet 6 by the operations illustrated in FIGS. 6A to 11B.

The following describes another exemplary operation when the folding processing unit 3 according to the embodiment performs the folding operation with reference to FIGS. 14A to 19. FIGS. 14A to 19 are cross-sectional views of the folding processing unit 3 in the folding processing operation in the image forming apparatus 1 according to the embodiment viewed from the direction perpendicular to the sheet conveyance direction. The operations of the respective operation components described below are controlled by the main control section 101 and the engine control section 102.

In FIGS. 14A to 19, "ON" or "OFF" indicated on the arrow from the first normal-reverse rotation roller pair 350 to the entrance conveyance roller pair 310, "ON" or "OFF" indicated on the arrow from the second normal-reverse rotation roller pair 370 to the entrance conveyance roller pair 310, and the solid arrow and the dotted arrow present the same as those presented in FIGS. 6A to 11B.

Figure 14A:
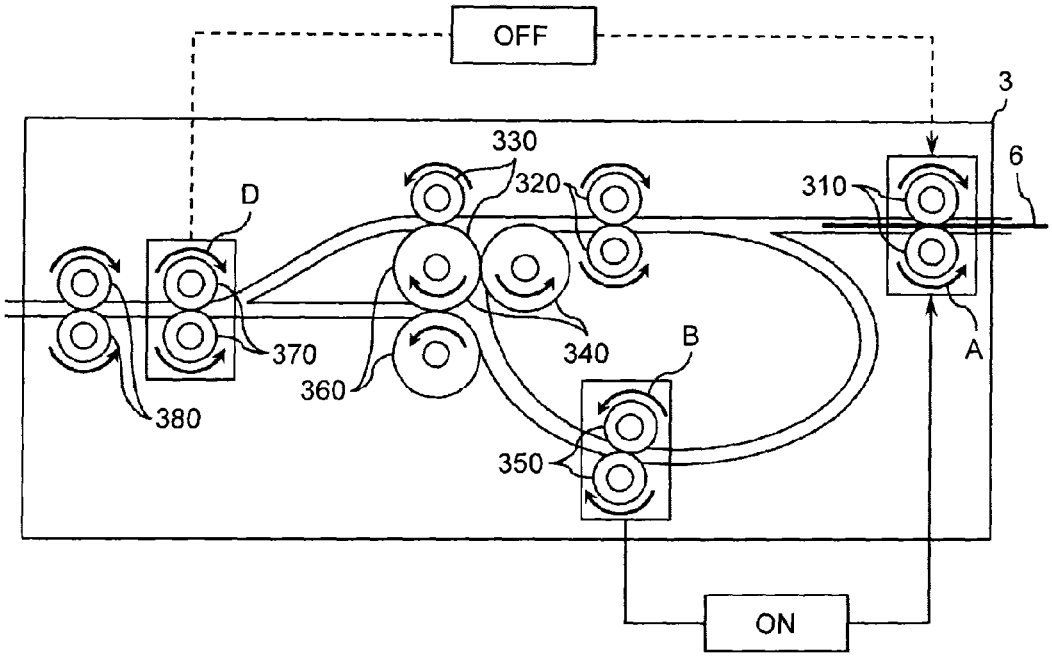
FIGS. 14A and 14B are cross-sectional views of the folding processing unit in the folding processing operation in the image forming apparatus according to the embodiment viewed from the direction perpendicular to the sheet conveyance direction.

The folding processing operation is performed by the folding processing unit 3 of the image forming apparatus 1 according to the embodiment as follows. As illustrated in FIG. 14A, the folding processing unit 3 receives the image-formed paper 6 conveyed from the image forming unit 2 by the entrance conveyance roller pair 310, and conveys the sheet 6 toward the registration roller pair 320.

The folding processing unit 3 performs the registration correction on the image-formed sheet 6 conveyed by the entrance conveyance roller pair 310 using the registration roller pair 320. Thereafter, as illustrated in FIG. 14B, the folding processing unit 3 further conveys the sheet 6 downstream in the conveyance direction using the first folding processing roller pair 340.

Figure 14B:
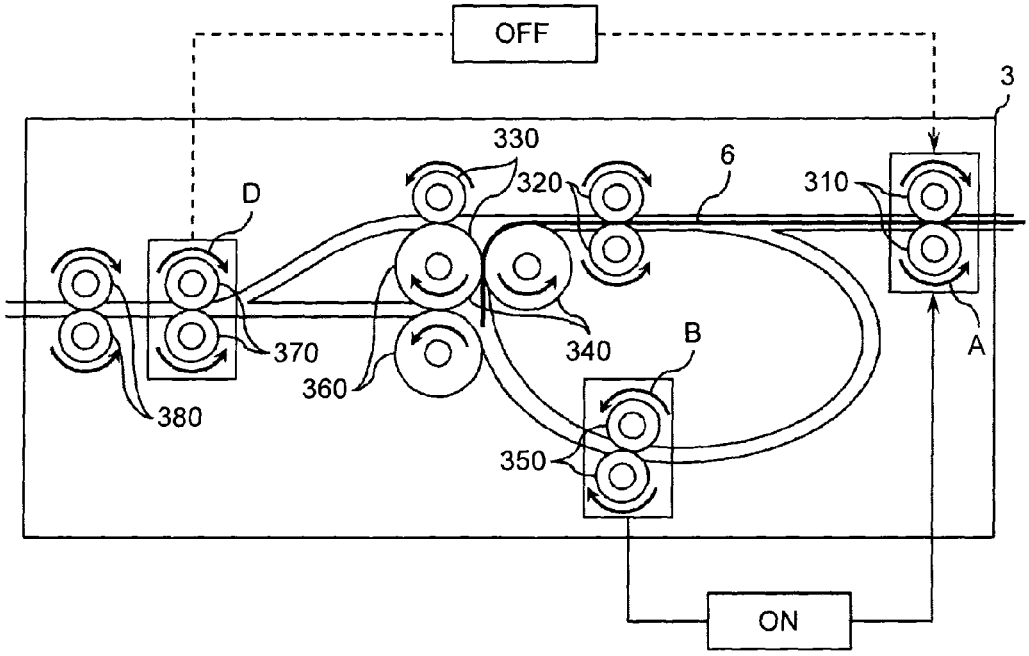

In FIGS. 14A and 14B, the entrance conveyance roller pair 310 is driven by the driving force transmitted from the driving motor 351 to rotate in the direction indicated with arrows A. The reason of the rotation is the same as that described with reference to FIGS. 6A and 6B.

Figure 15A:
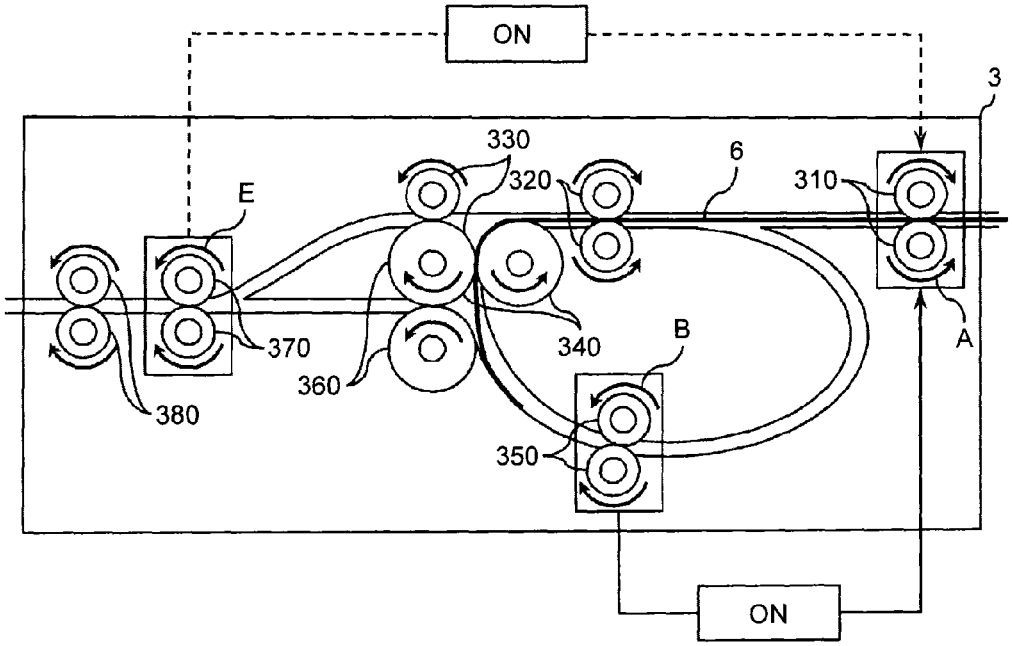
FIGS. 15A and 15B are cross-sectional views of the folding processing unit in the folding processing operation in the image forming apparatus according to the embodiment viewed from the direction perpendicular to the sheet conveyance direction.
Figure 15B:
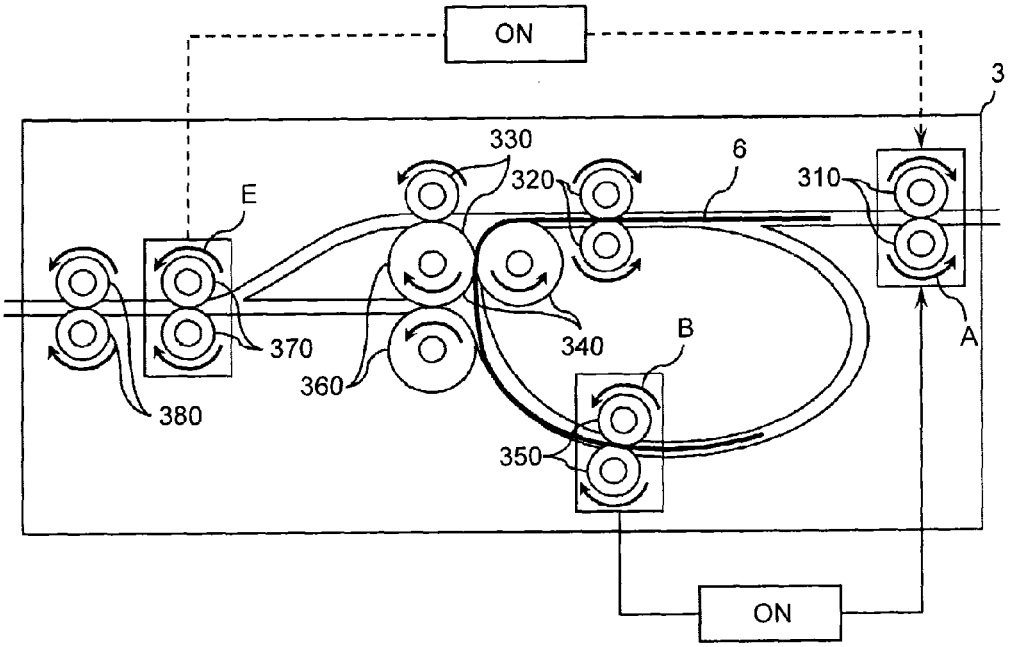

The folding processing unit 3 reverses the rotation of the second normal-reverse rotation roller pair 370 as illustrated in FIG. 15A and further conveys the sheet 6 downstream in the conveyance direction by the first folding processing roller pair 340 and the first normal-reverse rotation roller pair 350 as illustrated in FIG. 15B.

In FIGS. 15A and 15B, the second normal-reverse rotation roller pair 370 rotates in the direction indicated with arrows E while the first normal-reverse rotation roller pair 350 rotates in the direction indicated with arrows B. As a result, the driving force is capable of being transmitted to the entrance conveyance roller pair 310 from both of the driving motors 351 and 371. The entrance conveyance roller pair 310 is, however, actually driven to rotate in the direction indicated with arrows A by the driving force transmitted from only the driving motor 351. The reason of the rotation is the same as that described with reference to FIGS. 7A, 7B, and 8A.

Figure 16A:
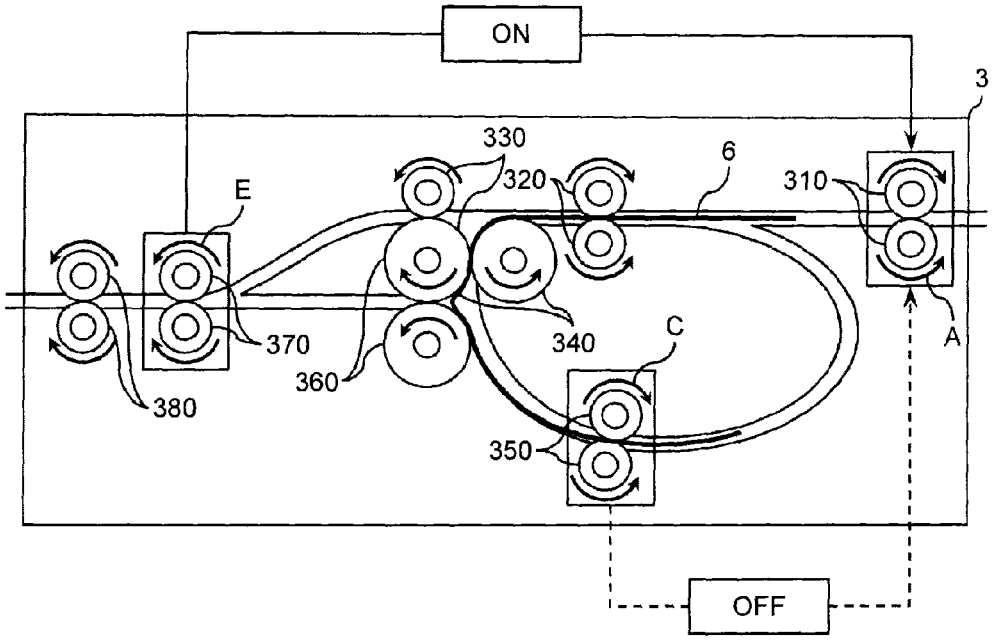
FIGS. 16A and 16B are cross-sectional views of the folding processing unit in the folding processing operation in the image forming apparatus according to the embodiment viewed from the direction perpendicular to the sheet conveyance direction.

The folding processing unit 3 conveys the sheet 6 by a certain distance. Then, as illustrated in FIG. 16A, the folding processing unit 3 reverses the rotation of the first normal-reverse rotation roller pair 350, thereby causing the folding position of the sheet 6 to be bent to a side adjacent to the second folding processing roller pair 360. The folding processing unit 3 further conveys the sheet 6 in such a manner that the position of the formed bending is not shifted while bending the folding position, thereby guiding the bending to the nip between the second folding processing roller pair 360.

In FIG. 16A, the driving motor that transmits the driving force to the entrance conveyance roller pair 310 is switched from the driving motor 351 to the driving motor 371. The entrance conveyance roller pair 310 is, thus, driven to rotate in the direction indicated with arrows A by the driving force transmitted from the driving motor 371. The reason of the rotation is the same as that described with reference to FIG. 8B.

Figure 16B:
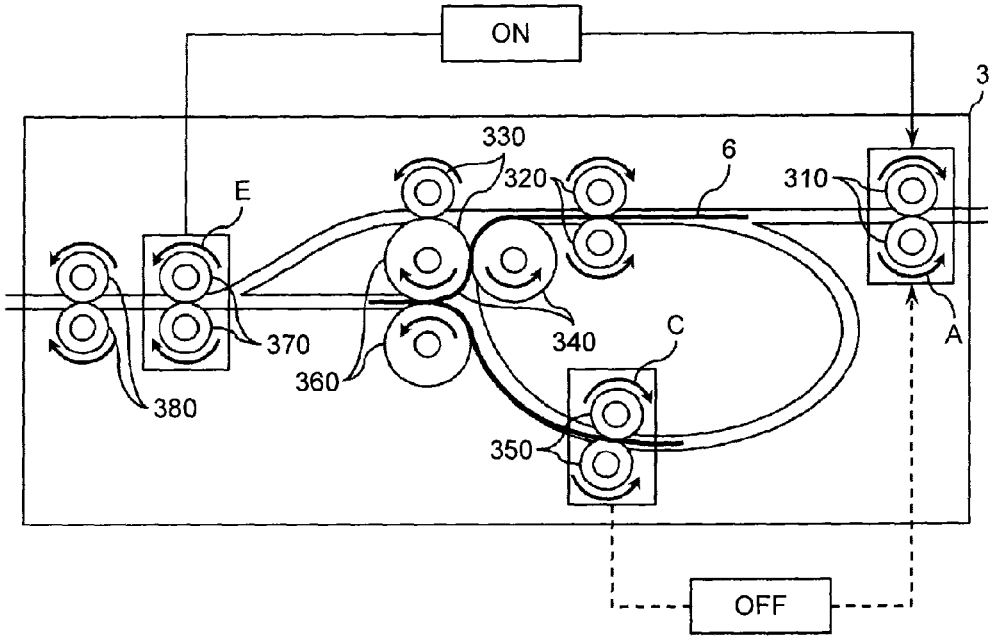
Figure 17A:
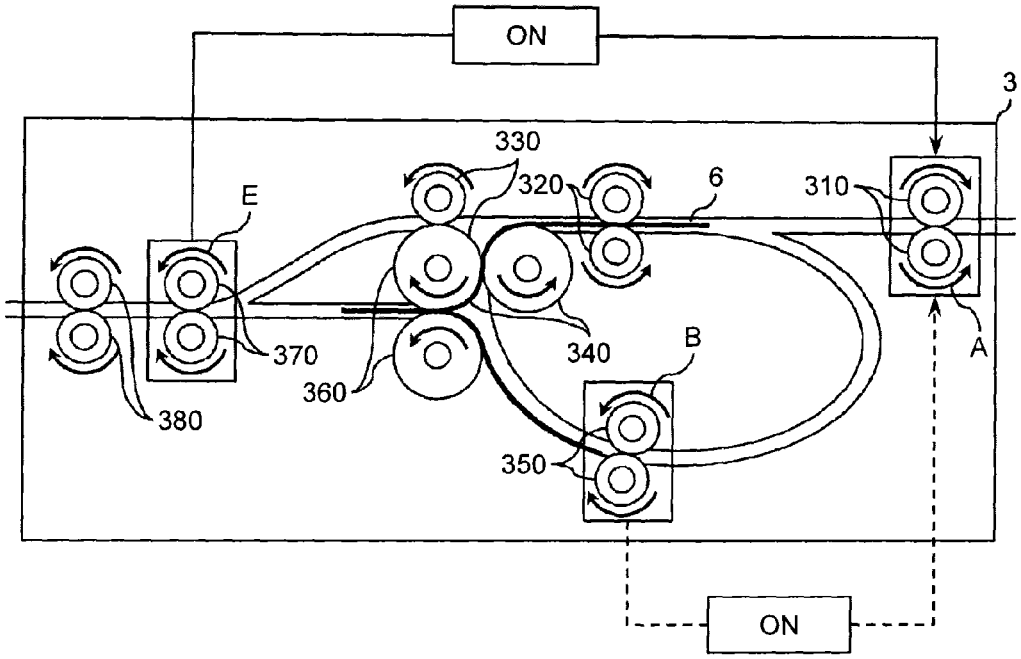
FIGS. 17A and 17B are cross-sectional views of the folding processing unit in the folding processing operation in the image forming apparatus according to the embodiment viewed from the direction perpendicular to the sheet conveyance direction.

As illustrated FIG. 16B, the folding processing unit 3 forms a fold at the folding position by sandwiching the bending formed on the sheet 6 from both sides at the nip between the second folding processing roller pair 360. Then, as illustrated in FIG. 17A, the folding processing unit 3 conveys the sheet 6 toward the second normal-reverse rotation roller pair 370 so as to further convey the sheet 6 downstream in the conveyance direction, and reverses the rotation of the first normal-reverse rotation roller pair 350 when the rear end of the sheet 6 exits the first normal-reverse rotation roller pair 350.

In FIG. 16B, the entrance conveyance roller pair 310 is driven by the driving force transmitted from the driving motor 371 to rotate in the direction indicated with arrows A. The reason of the rotation is the same as that described with reference to FIG. 9A. In FIG. 17A, the second normal-reverse rotation roller pair 370 rotates in the direction indicated with arrows E while the first normal-reverse rotation roller pair 350 rotates in the direction indicated with arrows B. As a result, the driving force is capable of being transmitted to the entrance conveyance roller pair 310 from both of the driving motors 351 and 371. The entrance conveyance roller pair 310 is, however, actually driven to rotate in the direction indicated with arrows A by the driving force transmitted from only the driving motor 371. The reason of the rotation is the same as that described with reference to FIG. 9B.

Figure 17B:
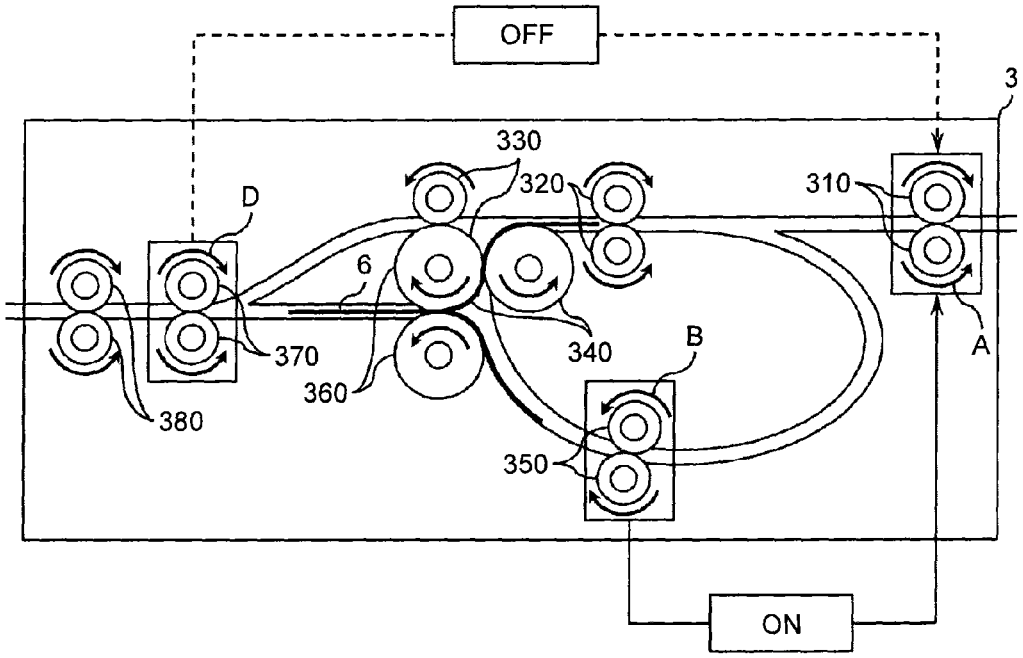

Thereafter, as illustrated in FIG. 17B, the folding processing unit 3 reverses the rotation of the second normal-reverse rotation roller pair 370 so as to start to prepare for conveying the sheet 6 downstream in the conveyance direction.

In FIG. 17B, the driving motor that transmits the driving force to the entrance conveyance roller pair 310 is switched from the driving motor 371 to the driving motor 351. The entrance conveyance roller pair 310 is, thus, driven to rotate in the direction indicated with arrows A by the driving force transmitted from the driving motor 351. The reason of the rotation is the same as that described with reference to FIG. 10A.

Figure 18A:
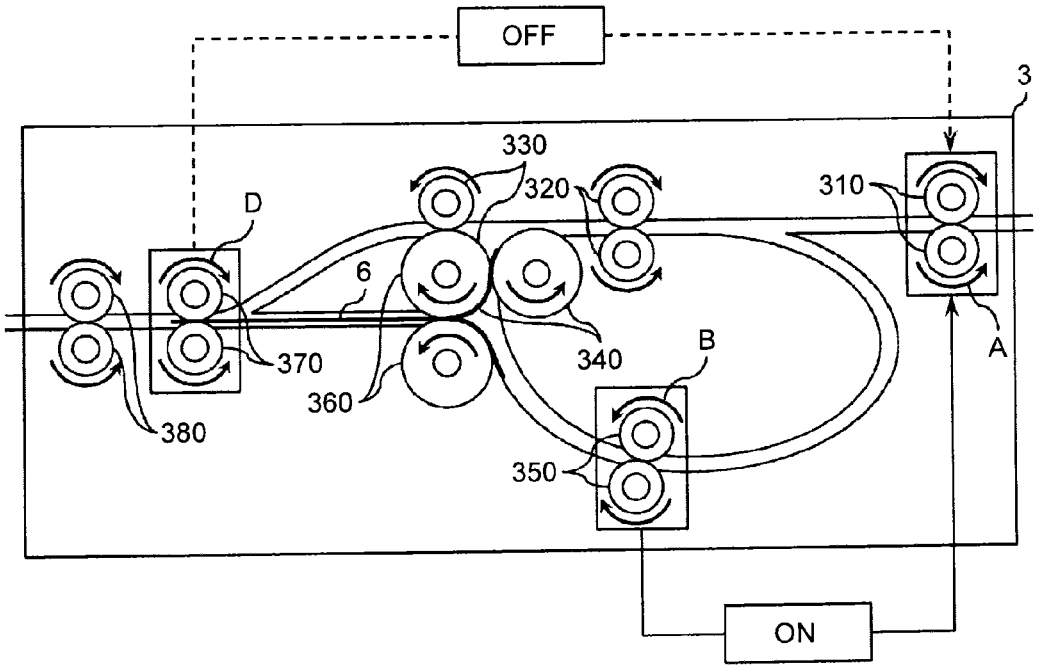
FIGS. 18A and 18B are cross-sectional views of the folding processing unit in the folding processing operation in the image forming apparatus according to the embodiment viewed from the direction perpendicular to the sheet conveyance direction.

As illustrated in FIG. 18A, the folding processing unit 3 conveys the sheet 6 conveyed from the second folding processing roller pair toward the sheet ejection roller pair 380 by the second normal-reverse rotation roller pair 370.

In FIG. 18A, the entrance conveyance roller pair 310 is driven by the driving force transmitted from the driving motor 351 to rotate in the direction indicated with arrows A. The reason of the rotation is the same as that described with reference to FIG. 10B.

Figure 18B:
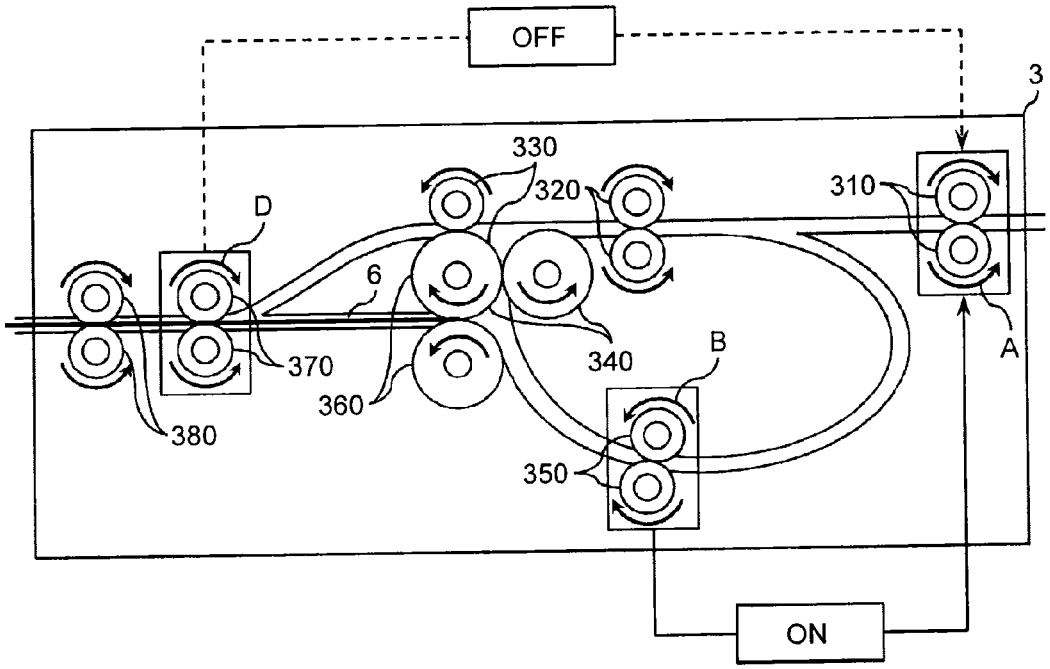
Figure 19:
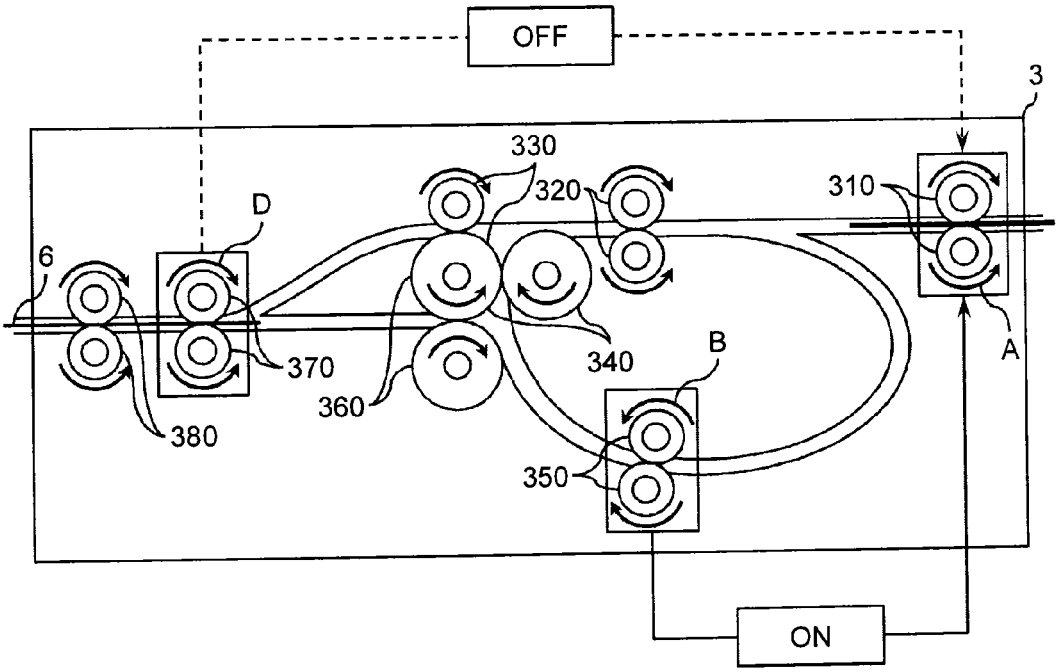
FIG. 19 is a cross-sectional view of the folding processing unit in the folding processing operation in the image forming apparatus according to the embodiment viewed from the direction perpendicular to the sheet conveyance direction.

When the sheet 6 is conveyed to the sheet ejection roller pair 380, the folding processing unit 3 ejects the sheet 6 by the sheet ejection roller pair 380 as illustrated in FIG. 18B, and receives the image-formed sheet 6 newly conveyed from the image forming unit 2 by the entrance conveyance roller pair 310 as illustrated in FIG. 19. The folding processing unit 3, then, performs the same processing as that described with reference to FIGS. 14A to 18B.

At this time, the driving force from the driving motor 371 is blocked from being transmitted to the entrance conveyance roller pair 310 in the folding processing unit 3. The folding processing unit 3, thus, can drive the second normal-reverse rotation roller pair 370 and the entrance conveyance roller pair 310 to rotate independently in accordance with the conveyance speeds of the sheet 6 of the respective second normal-reverse rotation roller pair 370 and the entrance conveyance roller pair 310 even when the conveyance speeds differ from each other.

Figure 20:
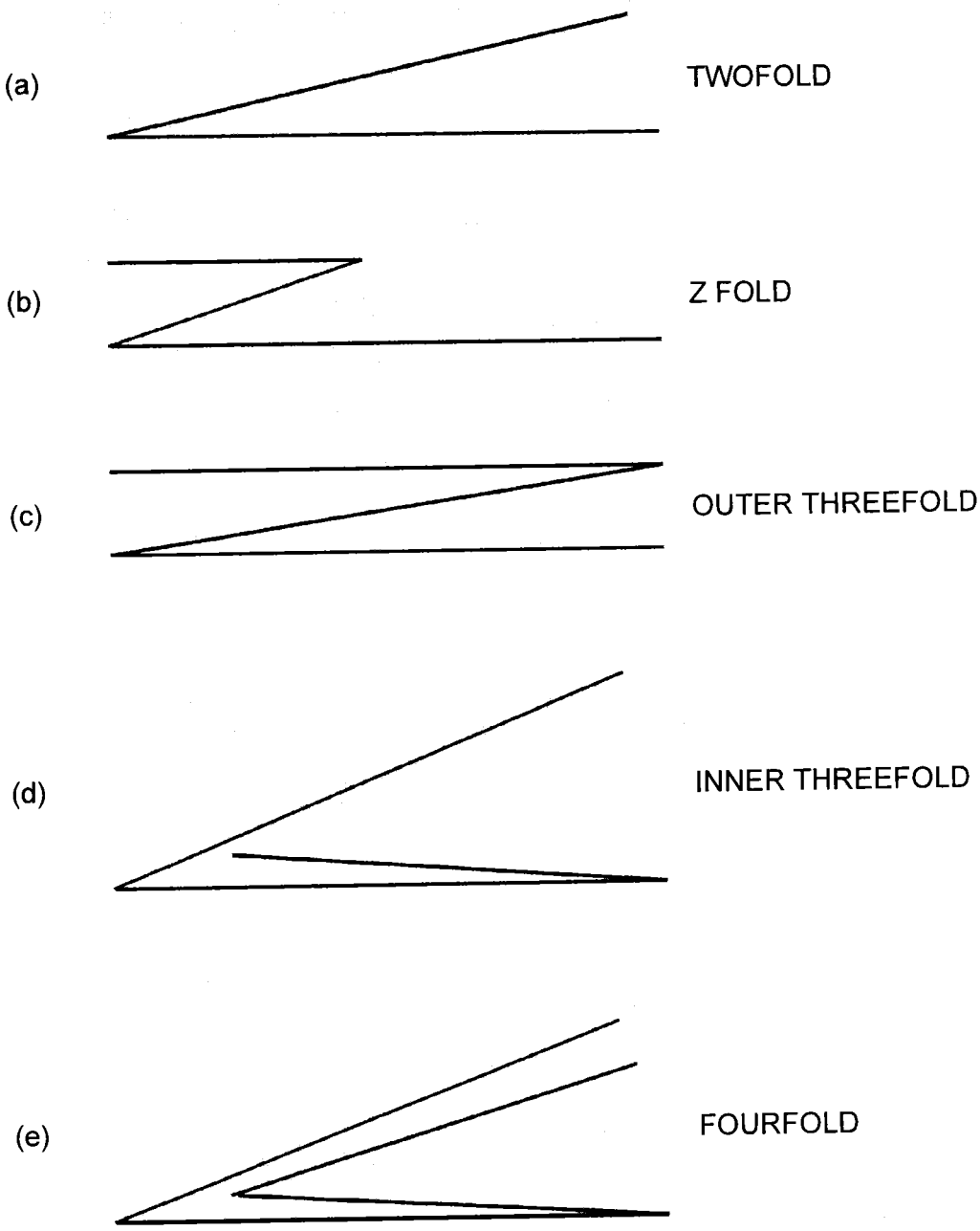
FIG. 20 is schematic diagram illustrating examples (a) to (e) of a shape of sheet after being subjected to the folding processing performed by the folding processing unit according to the embodiment.

FIG. 20 is schematic diagram illustrating examples (a) to (e) of the shape of the sheet 6 after being subjected to the folding processing performed by the folding processing unit 3 according to the embodiment.

As described above, the folding processing unit 3 according to the embodiment uses the driving motors 351 and 371, which drive the first normal-reverse rotation roller pair 350 and the second normal-reverse rotation roller pair 370 to rotate, respectively, by switching them with each other in accordance with a change in the directions of the rotations thereof so as to drive the entrance conveyance roller pair 310 to rotate, thereby ensuring the entrance conveyance roller pair 310 to continue the rotation in an intended direction.

The folding processing unit 3 according to the embodiment can ensure the entrance conveyance roller pair 310 to continue the rotation in such a direction that the entrance conveyance roller pair 310 conveys the sheet 6 downstream in the conveyance direction without requiring a dedicated driving motor that drives the entrance conveyance roller pair 310 to rotate. As a result, the folding processing unit 3 that has a compact and simple structure and performs the folding processing on the sheet 6 can be provided with a low cost.

In the embodiment, the image forming unit 2, the folding processing unit 3, the additional folding processing unit 4, and the scanner unit 5 are included in the image forming apparatus 1. The units may be devices independent from one another that may form an image forming system by being connected with one another.

The embodiment of the invention can provide a low cost folding processing apparatus that has a compact and simple structure and performs the folding processing on a sheet.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet processing apparatus, comprising:

a conveyance roller pair that rotates in a certain direction to convey a sheet;

a first normal-reverse rotation roller pair that is capable of rotating in a normal direction and a reverse direction and rotates to convey the sheet;

a first driver that drives the first normal-reverse rotation roller pair to rotate;

a first driving force transmitter that transmits a driving force of the first driver for rotating the first normal-reverse rotation roller pair in a first specific direction to the conveyance roller pair so as to rotate the conveyance roller pair in the certain direction, and blocks a driving force of the first driver for rotating the first normal-reverse rotation roller pair in the direction opposite to the first specific direction from being transmitted to the conveyance roller pair;

a second normal-reverse rotation roller pair that is capable of rotating in a normal direction and a reverse direction and rotates to convey the sheet;

a second driver that drives the second normal-reverse rotation roller pair to rotate; and a second driving force transmitter that transmits a driving force of the second driver for rotating the second normal-reverse rotation roller pair in a second specific direction to the conveyance roller pair so as to rotate the conveyance roller pair in the certain direction, and blocks a driving force of the second driver for rotating the second normal-reverse rotation roller pair in the direction opposite to the second specific direction from being transmitted to the conveyance roller pair.

2. The sheet processing apparatus according to claim 1, wherein, when the first driver drives the first normal-reverse rotation roller pair to rotate in the first specific direction and the second driver drives the second normal-reverse rotation roller pair to rotate in the second specific direction, out of the first and the second drivers, the driving force of one driver that rotates the conveyance roller pair at a faster speed than the other driver rotates the conveyance roller pair is transmitted to the conveyance roller pair, and the driving force of the other driver is blocked from being transmitted to the conveyance roller pair.

3. The sheet processing apparatus according to claim 1, further comprising a driving controller that controls driving of the first driver and the second driver, wherein, when a transmission driver that transmits the driving force to the conveyance roller pair is switched between the first driver and the second driver, the driving controller accelerates a driving speed of a non-transmission driver that does not transmit the driving force to the conveyance roller pair up to certain acceleration until the transmission driver is switched, and when the driving speed of the non-transmission driver reaches the certain acceleration, the driving controller reduces a driving speed of the transmission driver that is transmitting the driving force to the conveyance roller pair.

4. The sheet processing apparatus according to claim 1, further comprising a folding processing roller pair that rotates while sandwiching surfaces of the sheet being bent to form a fold on the sheet, wherein the first normal-reverse rotation roller pair bends the sheet toward the folding processing roller pair by conveying one end side of the sheet in a conveyance direction of the sheet to the other end side of the sheet in the conveyance direction while the other end side of the sheet in the conveyance direction is held, the folding processing roller pair forms the fold on the sheet bent by the first normal-reverse rotation roller pair, and the second normal-reverse rotation roller pair conveys the sheet on which the fold has been formed.

5. The sheet processing apparatus according to claim 1, wherein the first driving force transmitter transmits the driving force of the first driver to the conveyance roller pair from when the conveyance roller pair starts to convey the sheet in a forward direction until the first normal-reverse rotation roller pair conveys the sheet in the forward direction by a certain distance.

6. The sheet processing apparatus according to claim 5, wherein the second driving force transmitter transmits the driving force of the second driver to the conveyance roller pair from when the rotation of the first normal-reverse rotation roller pair is reversed after the first normal-reverse rotation roller pair conveys the sheet in the forward direction by the certain distance until the sheet exits the first normal-reverse rotation roller pair.

7. The sheet processing apparatus according to claim 6, wherein the first driving force transmitter transmits the driving force of the first driver to the conveyance roller pair from when the rotation of the first normal-reverse rotation roller pair is reversed and the sheet exits the first normal-reverse rotation roller pair until the first normal-reverse rotation roller pair conveys a next sheet in the forward direction by the certain distance.

8. An image forming system, comprising:

an image forming apparatus that performs image forming output on the sheet; and the sheet processing apparatus according to claim 1.

9. The sheet processing apparatus according to claim 1, wherein:

the first driving force transmitter includes a one-way clutch.

10. The sheet processing apparatus according to claim 9, wherein:

the second driving force transmitter includes a one-way clutch.

* * * * *